US010606192B2

(12) United States Patent
Odagiri

(10) Patent No.: US 10,606,192 B2
(45) Date of Patent: Mar. 31, 2020

(54) IMAGE FORMING APPARATUS AND METHOD OF CONTROLLING THE SAME

(71) Applicant: KONICA MINOLTA, INC., Chiyoda-ku, Tokyo (JP)

(72) Inventor: Kazuki Odagiri, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 16/412,739

(22) Filed: May 15, 2019

(65) Prior Publication Data

US 2019/0354043 A1 Nov. 21, 2019

(30) Foreign Application Priority Data

May 16, 2018 (JP) ..... 2018-094340

(51) Int. Cl.
*G03G 21/00* (2006.01)
*G03G 15/16* (2006.01)
*G03G 15/00* (2006.01)

(52) U.S. Cl.
CPC ..... *G03G 15/1665* (2013.01); *G03G 15/553* (2013.01)

(58) Field of Classification Search
CPC ..... G03G 15/553; G03G 15/1665
See application file for complete search history.

(56) References Cited

U.S. PATENT DOCUMENTS

2017/0219950 A1* 8/2017 Murata ..... G03G 15/0266
2019/0286018 A1* 9/2019 Harashima ..... G03G 15/553

FOREIGN PATENT DOCUMENTS

JP 2014139614 A 7/2014

* cited by examiner

*Primary Examiner* — David M. Gray
*Assistant Examiner* — Michael A Harrison
(74) *Attorney, Agent, or Firm* — Buchanan Ingersoll & Rooney PC

(57) ABSTRACT

An image forming apparatus calculates a post exposure potential after exposure by an exposure device based on a first charge voltage, a second charge voltage, a charge current in a first change characteristic when a transfer voltage is the first charge voltage, a charge current in a second change characteristic when the charge voltage is the first charge voltage, a charge current in the first change characteristic when the charge voltage is the second charge voltage, and a charge current in the second change characteristic when the charge voltage is the second charge voltage, and makes a determination as to life of an image carrier based on the post exposure potential.

16 Claims, 16 Drawing Sheets

IMAGE FORMING APPARATUS AND METHOD OF CONTROLLING THE SAME

The entire disclosure of Japanese Patent Application No. 2018-094340, filed on May 16, 2018, is incorporated herein by reference in its entirety.

BACKGROUND

Technological Field

The present disclosure relates to an image forming apparatus and a method of controlling the same.

Description of the Related Art

For an image forming apparatus including a photoconductor, a technique of predicting the life of the photoconductor has been conventionally proposed. For example, the image forming apparatus disclosed in Japanese Laid-Open Patent Publication No. 2014-139614 forms an image on a sheet by, for example, exposure of a photoconductor by an exposure unit. In the image forming apparatus, a potential measuring device measures a post exposure potential after the exposure of the photoconductor. The image forming apparatus determines the life of the photoconductor based on the post exposure potential.

SUMMARY

The potential measuring device is used in the image forming apparatus described in Japanese Laid-Open Patent Publication No. 2014-139614 as described above. However, the image forming apparatus is expensive due to a high cost of the potential measuring device. This leads to a demand for a technique of reducing the cost of the image forming apparatus.

To achieve at least one of the abovementioned objects, according to an aspect of the present invention, an image forming apparatus reflecting one aspect of the present invention comprises: a transfer member; an image carrier; a charging device configured to charge the image carrier based on a charge voltage; a charge current acquirer configured to detect a charge current output when the image carrier is charged; an exposure device configured to expose the image carrier; a transfer device configured to transfer a toner image to the transfer member upon application of a transfer voltage; a transfer current detector configured to detect a transfer current output upon application of the transfer voltage; a characteristic acquirer configured to change the transfer voltage to a plurality of voltage values and acquire characteristics of the transfer current and the charge current based on the transfer current and the charge current at each of the plurality of voltage values; a change characteristic acquirer configured to acquire a first change characteristic and a second change characteristic each of when the charge voltage is a first charge voltage and when the charge voltage is a second charge voltage, the first change characteristic and the second change characteristic being two change characteristics that change in the characteristics; a calculator configured to calculate a post exposure potential after the exposure by the exposure device based on the first charge voltage, the second charge voltage, the charge current in the first change characteristic when the charge voltage is the first charge voltage, the charge current in the second change characteristic when the charge voltage is the first charge voltage, the charge current in the first change characteristic when the charge voltage is the second charge voltage, and the charge current in the second change characteristic when the charge voltage is the second charge voltage; and a determiner configured to make a determination as to life of the image carrier based on the post exposure potential.

In an aspect, the first change characteristic is a characteristic in which a change amount of a ratio of the charge voltage to the transfer current is a first value, and the second change characteristic is a characteristic in which the change amount of the ratio of the charge voltage to the transfer current is a second value smaller than the first value.

In an aspect, the determiner is configured to determine whether the post exposure potential is more than or equal to a threshold voltage. When it is determined that the post exposure potential is more than or equal to the threshold voltage, the determiner is configured to perform a change process of changing an exposure intensity of the exposure device, and the calculator is configured to perform a process of calculating the post exposure potential again at the changed exposure intensity. The change process and the process of calculating the post exposure potential again by the calculator are repeated until the post exposure potential calculated again falls below the threshold voltage.

In one aspect, the determiner is configured to determine that the life of the image carrier is reached when the exposure intensity reaches a maximum exposure intensity through the change process and when the determiner determines that the post exposure potential calculated again is more than the threshold voltage.

In one aspect, the image forming apparatus further comprises an image forming device configured to form an image on a sheet. The exposure device is configured to, when the determiner determines that the post exposure potential calculated again is less than the threshold voltage, expose the image carrier at an exposure intensity in the determination such that the image forming device forms an image on a sheet.

In one aspect, the determiner is configured to acquire a first allowable operation amount of the image carrier based on the post exposure potential calculated by the calculator, a use amount of the image forming apparatus when the post exposure potential is calculated, a previous post exposure potential calculated before the post exposure potential, and a use amount of the image forming apparatus when the previous post exposure potential is calculated.

In one aspect, the determiner is configured to acquire a second allowable operation amount of the image carrier from a film thickness of the image carrier, and determine a smaller amount of the first allowable operation amount and the second allowable operation amount as an allowable operation amount of the image carrier.

In one aspect, the image forming apparatus further comprises a charge neutralizing device configured to neutralize a charge of the image carrier before the image carrier is charged by the charging device.

In one aspect, the charge neutralizing device is configured to perform a process identical to a process performed by the exposure device.

In one aspect, the exposure device is configured to neutralize a charge of the image carrier before the image carrier is charged by the charging device.

According to an aspect of the present invention, a method of controlling an image forming apparatus reflecting one aspect of the present invention comprises: exposing an image carrier; detecting a charge current output when the image carrier is charged; detecting a transfer current output upon application of a transfer voltage; changing the transfer voltage to a plurality of voltage values and acquiring characteristics of the transfer current and the charge current based on the transfer current and the charge current at each of the plurality of voltage values; acquiring a first change characteristic and a second change characteristic each of when the charge voltage is a first charge voltage and when the charge voltage is a second charge voltage, the first change characteristic and the second change characteristic being two change characteristics that change in the characteristics; calculating a post exposure potential after the exposure based on the first charge voltage, the second charge voltage, the charge current in the first change characteristic when the charge voltage is the first charge voltage, the charge current in the second change characteristic when the charge voltage is the first charge voltage, the charge current in the first change characteristic when the charge voltage is the second charge voltage, and the charge current in the second change characteristic when the charge voltage is the second charge voltage; and making a determination as to life of the image carrier based on the post exposure potential.

In one aspect, the first change characteristic is a characteristic in which a change amount of a ratio of the charge voltage to the transfer current is a first value, and the second change characteristic is a characteristic in which the change amount of the ratio of the charge voltage to the transfer current is a second value smaller than the first value.

In one aspect, the making of a determination as to the life of the image carrier based on the post exposure potential includes: determining whether the post exposure potential is more than or equal to a threshold voltage; when it is determined that the post exposure potential is more than or equal to the threshold voltage, performing a change process of changing an exposure intensity of an exposure device and performing a process of calculating the post exposure potential again at the changed exposure intensity; and repeating the change process and the process of calculating the post exposure potential again until the post exposure potential calculated again falls below the threshold voltage.

In one aspect, the making of a determination as to the life of the image carrier based on the post exposure potential includes determining that an end of the life of the image carrier is reached when it is determined that the exposure intensity reaches a maximum exposure intensity through the change process and when it is determined that the post exposure potential calculated again is more than the threshold voltage.

In one aspect, the exposing includes, when it is determined that the post exposure potential calculated again is less than the threshold voltage, exposing the image carrier at an exposure intensity in the determination.

In one aspect, the making of a determination as to the life of the image carrier based on the post exposure potential includes acquiring a first allowable operation amount of the image carrier based on the post exposure potential, a use amount of the image forming apparatus when the post exposure potential is calculated, a previous post exposure potential calculated before the post exposure potential, and a use amount of the image forming apparatus when the previous post exposure potential is calculated In one aspect, the making of a determination as to the life of the image carrier based on the post exposure potential includes acquiring a second allowable operation amount of the image carrier from a film thickness of the image carrier, and determining a smaller amount of the first allowable operation amount and the second allowable operation amount as an allowable operation amount of the image carrier.

In one aspect, the method further comprises neutralizing a charge of the image carrier before the image carrier is charged.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
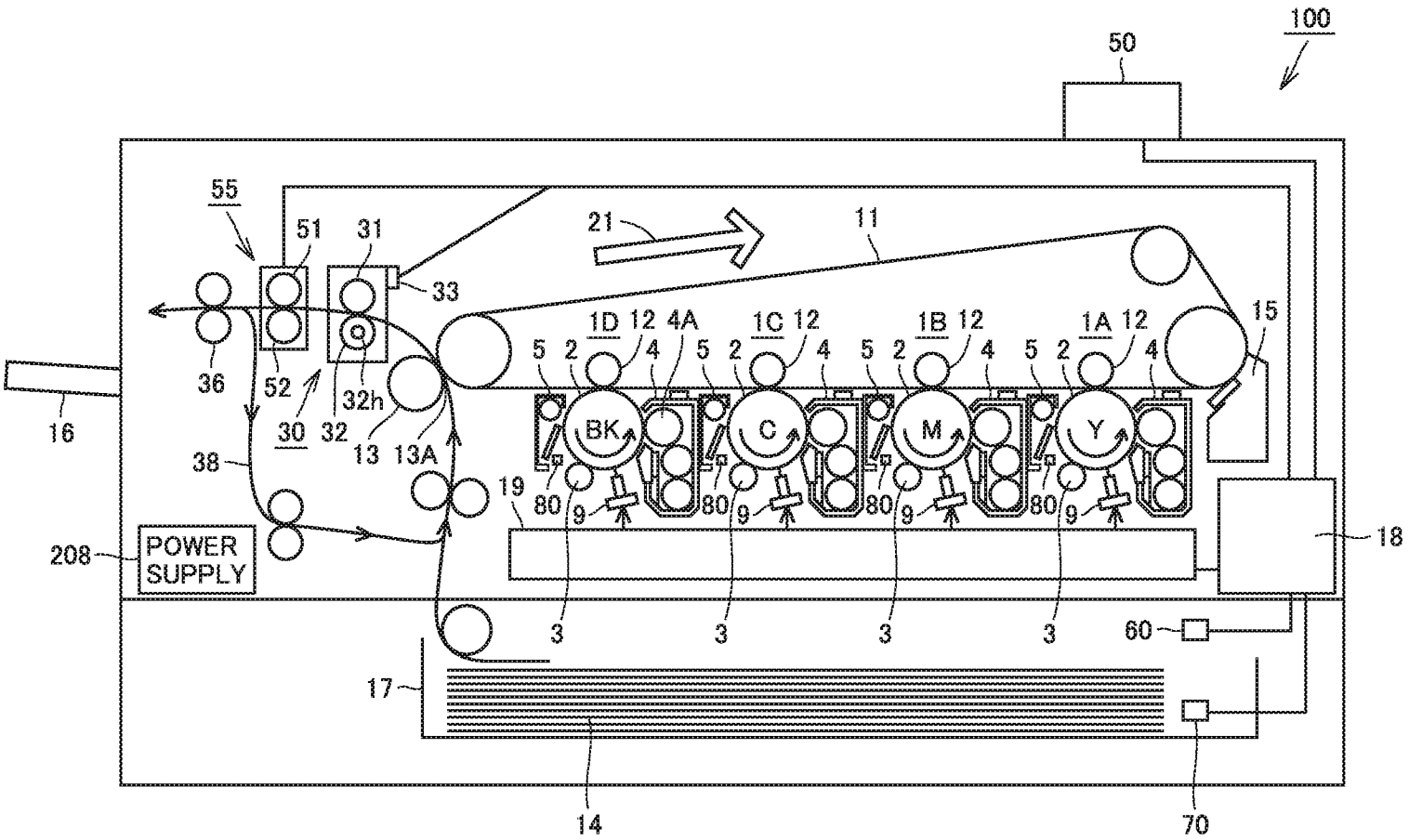
FIG. 1 shows an overall configuration of an image forming apparatus.

Hereinafter, one or more embodiments of the present invention will be described with reference to the drawings. However, the scope of the invention is not limited to the disclosed embodiments.

An image forming apparatus in an embodiment according to the present invention will be described below with reference to the drawings. In the embodiments described below, when the number, the quantity and the like are mentioned, the scope of the present invention is not necessarily limited thereto unless otherwise specified. The same or corresponding components are designated by the same reference characters, and the description thereof may not be repeated. Furthermore, it has been originally intended to combine configurations described in each embodiment as appropriate.

Referring to FIG. 1, a schematic configuration of an image forming apparatus 100 in the present embodiment will be described. FIG. 1 shows the internal configuration of image forming apparatus 100.

FIG. 1 shows image forming apparatus 100 serving as a color printer. Although description will be given of image forming apparatus 100 serving as a color printer, image forming apparatus 100 is not limited to the color printer. For example, image forming apparatus 100 may be a monochrome printer, or an MPF (multi-functional peripheral) including a monochrome printer, a color printer, and a facsimile machine.

Image forming apparatus 100 mainly includes image forming units 1A to 1D serving as a formation device, an intermediate transfer belt 11 (intermediate transfer member), primary transfer rollers 12 (transfer device), a secondary transfer roller 13, a cleaner 15, a paper discharge tray 16, a cassette 17, a controller 18, an exposure controller 19, a fixing device 30 serving as a fixer, paper discharge rollers 36, and a reverse transport path 38.

Image forming unit 1A forms a yellow (Y) toner image. Image forming unit 1B forms a magenta (M) toner image. Image forming unit 1C forms a cyan (C) toner image. Image forming unit 1D forms a black (BK) toner image.

Intermediate transfer belt 11 is an endless belt and is driven to go around in a direction of an arrow 21 by rotation of at least one driving roller of a plurality of support rollers. Image forming units 1A to 1D are arranged in order in the direction of driving of intermediate transfer belt 11.

Image forming units 1A to 1D each include a photoconductor 2, a charging device 3, a developer 4, a photoconductor cleaner 5, an exposure device 9, and a charge neutralizing device 80. Photoconductor 2 is an image carrier that carries a toner image thereon. In one example, a photoconductor drum having a photosensitive layer formed thereon is used as photoconductor 2. Photoconductor 2 rotates in a direction corresponding to the direction of driving of intermediate transfer belt 11.

Charging device 3 uniformly charges the surface of photoconductor 2 in negative polarity (e.g., −500 V). Charging device 3 is, for example, a conductive rubber roller and is arranged to contact photoconductor 2. Charging device 3 rotates in accordance with the rotational driving of photoconductor 2. A voltage (hereinafter, also referred to as a charge bias or charge voltage) is applied to charging device 3 by a power supply 208. Power supply 208 outputs a dc voltage that is constant-voltage-controlled to a predetermined voltage. For example, −1050 V is applied to charging device 3 by a DC power supply. Photoconductor 2 is uniformly charged to −500 V by charging device 3. That is to say, charging device 3 charges photoconductor 2 based on the charge voltage. The image forming apparatus may be configured such that charging device 3 has a configuration of superimposing ac voltage on dc voltage. Charging device 3 may be a scorotron charging device.

Exposure device 9 irradiates photoconductor 2 with laser light in accordance with a control signal from exposure controller 19 and exposes the surface of photoconductor 2 in accordance with a specified image pattern. The surface potential of an exposed portion of photoconductor 2 is reduced to, for example, −100 V. The surface potential of a portion of photoconductor 2, which has not been exposed, is kept at the charge potential. This exposure forms electrostatic latent images of respective colors (YMCK) on photoconductors 2.

Developer 4 develops the electrostatic latent image formed on photoconductor 2 as a toner image. In one example, developer 4 develops an electrostatic latent image using a two-component developer composed of toner and carrier. The carrier is, for example, iron powder. The toner is of each color (Y, M, C, BK). Developer 4 has a developing roller 4A therein. For example, a developing bias is applied to developing roller 4A. This developing bias is a bias obtained by superimposing a "square wave of 5 khz at Vpp=1.4 kv" on Vb=−400 V. Through triboelectric charging of the toner and carrier, the toner and carrier are charged (e.g., electrostatically) in opposite polarities. In the present embodiment, the toner has a negative polarity and the carrier has a positive polarity. That is to say, this mixing charges the toner. In a modification, the toner may have a positive polarity and the carrier may have a negative polarity.

The toner is supplied to a reduced portion of photoconductor 2, which has a reduced surface potential through exposure, whereas the toner is not supplied to a portion (a portion whose surface potential is not reduced) other than the reduced portion. Consequently, a toner image of each color is formed on photoconductor 2.

The toner image formed on photoconductor 2 is in contact with intermediate transfer member 11 pressed by primary transfer roller 12. Primary transfer roller 12 is, for example, either a semiconductive rubber roller or a metal roller. A transfer bias of a polarity (i.e., positive polarity) opposite to that of the toner is applied to primary transfer roller 12. A transfer electric field is formed by the transfer bias. As a result of this transfer electric field, the toner image contacting with intermediate transfer member 11 is transferred to intermediate transfer member 11. This transfer bias has a positive polarity, whereas the charge bias has a negative polarity, so that the transfer bias and the charge bias have opposite polarities. The image forming apparatus performs control of transferring the respective toner images of first to four colors (respective toner images of YMCK) to intermediate transfer belt 11 in synchronization to overlap one another. In this manner, a toner image is transferred to intermediate transfer belt 11 by application of a transfer voltage to primary transfer roller 12.

Cassette 17 is provided in a lower portion of image forming apparatus 100. Sheets 14 such as paper are placed in cassette 17. Sheets 14 are fed to secondary transfer roller 13 from cassette 17 one by one. A timing at which sheet 14 is fed and transported is synchronized with the position of a toner image (a toner image on which each color is superimposed) on intermediate transfer belt 11, thereby transferring the toner image to an appropriate position of sheet 14. Sheet 14 is subsequently fed to fixing device 30.

Fixing device 30 melts the toner image (a toner image that has not been fixed) transferred to sheet 14 to fix the toner image onto sheet 14. Fixing device 30 includes a fixing roller 32, a pressure roller 31, and a fixing temperature detector 33. Fixing roller 32 serves as a heating member that is heated by a heater 32*h* serving as a heating device. Pressure roller 31 serves as a pressure member that nips sheet 14 having an image, which has not been fixed, formed on the surface thereof together with fixing roller 32 and fixes the image that has not been fixed onto sheet 14 while passing sheet 14 between fixing roller 32 and pressure roller 31. Controller 18 performs fixing temperature control based on the result of the detection by fixing temperature detector 33.

Image forming apparatus 100 can receive user's input of commands from an operation unit 50 to execute jobs. The jobs include a one-side printing job (a job of causing one-side printing), a double-side printing job (a job of causing double-side printing), a scan job (a job of causing scan), and any other job.

When the user inputs the command of the one-side printing job, sheet 14 is ejected to paper discharge tray 16 by paper discharge rollers 36 after a fixing process by fixing device 30. When the user inputs the command of the double-side printing job, sheet 14 is fed to reverse transport path 38 by reverse rotation of paper discharge rollers 36 after the fixing process by fixing device 30. Subsequently, the sheet is fed to secondary transfer roller 13 such that a toner image is transferred to the rear surface (second surface) of the sheet. Secondary transfer roller 13 transfers the toner image to an appropriate position on the rear surface of sheet 14. Subsequently, sheet 14 is fed to fixing device 30 again, so that fixing device 30 fixes the toner image to the rear surface of the sheet. In this manner, when the user inputs the command of the double-side printing job, printing can be performed on both sides.

Cleaner 15 includes a cleaning blade. The cleaning blade is pressed against intermediate transfer belt 11 and collects toner particles remaining on intermediate transfer belt 11 after transfer of a toner image. The toner particles are transported by a transport screw (not shown) and are collected in a waste toner container (not shown).

Controller 18 controls an image formation process of image forming apparatus 100. Controller 18 controls image forming units 1A to 1D, secondary transfer roller 13, fixing device 30 (e.g., controls the temperature of heater 32*h* and the rotation speed of pressure roller 31), exposure controller 19, and the like.

A cooler 55 is provided downstream of fixing device 30. Cooler 55 includes a cooling roller 52 (cooling portion) and a counter roller 51 (counter portion). Cooler 55 is controlled by controller 18. Counter roller 51 faces cooling roller 52, and counter roller 51 and cooling roller 52 nip the sheet therebetween.

Since counter roller 51 and cooling roller 52 nip a sheet therebetween and cool the sheet in this manner, image forming apparatus 100 can stably cool the sheet.

Intermediate transfer belt 11 is made of a semiconductive material mainly containing polycarbonate, PTFE (polytetrafluoroethylene), or polyimide and containing dispersed carbon.

[Hardware Configuration]

Figure 2:
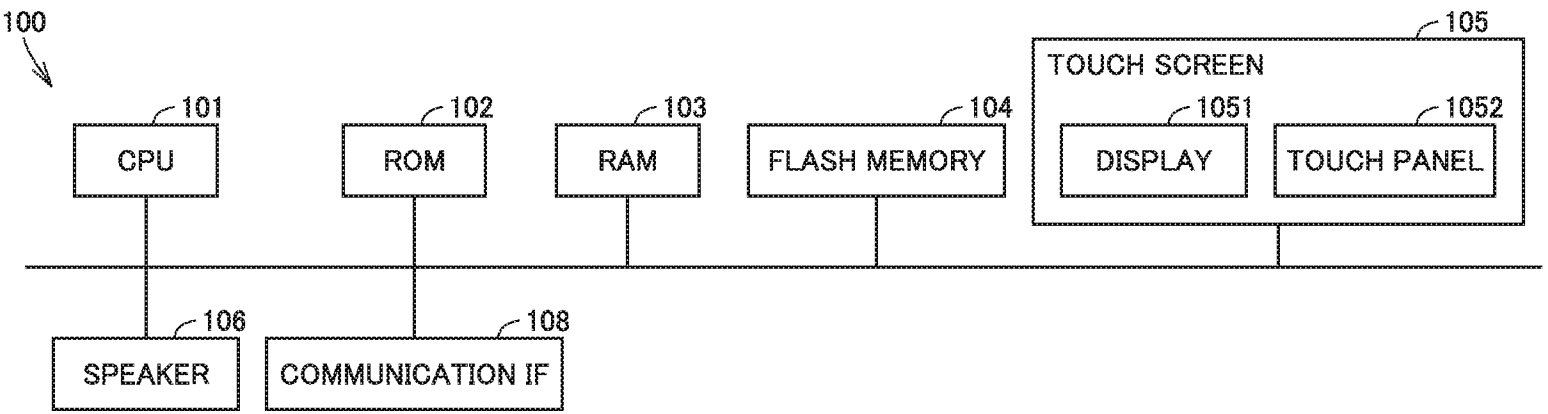
FIG. 2 shows a hardware configuration of the image forming apparatus.

FIG. 2 shows a hardware configuration of image forming apparatus 100. Referring to FIG. 2, image forming apparatus 100 includes a CPU (central processing unit) 101 that executes a program, a read only memory (ROM) 102 that stores data in a nonvolatile manner, a RAM (Random Access Memory) 103 that stores data in a volatile manner, a flash memory 104, a touch screen 105, a speaker 106, and a communication IF 108.

Touch screen 105 includes a display 1051 serving as a display device and a touch panel 1052 serving as an input device. Specifically, touch screen 105 is achieved by positioning and then fixing touch panel 1052 on display 1051 (e.g., liquid crystal display). The touch screen is also referred to as a touch panel display, a display with a touch panel, or a touch panel monitor. Touch screen 105 may use a resistive type or capacitive type as a way of detecting a touch position. When the user operates touch screen 105, a command is input.

Flash memory 104 is a nonvolatile semiconductor memory. Flash memory 104 stores an operating system and various programs executed by CPU 101, various contents, and data. Flash memory 104 stores various data such as data generated by image forming apparatus 100 and data acquired from a device external to image forming apparatus 100 in a volatile manner.

Speaker 106 generates sound in response to a command from CPU 101. CPU 101 specifies an input position based on the output from touch panel 1052 and performs a screen display based on the specified input position.

Communication IF 108 is connected to another external device (e.g., PC (personal computer)) through a network. Upon receipt of a user's input of a job from the other external device, image forming apparatus 100 acquires the job via communication IF 108.

The process in image forming apparatus 100 is implemented by each piece of hardware and software executed by CPU 101. Such software may be preliminarily stored in flash memory 104. The components of image forming apparatus 100 shown in FIG. 2 are commonly used ones. It can thus be said that the essential part of the present invention is software that is stored in flash memory 104, a memory card, or any other recording medium, or software that can be downloaded through a network. An operation of each piece of hardware of image forming apparatus 100 is well known, detailed description of which will not be repeated.

A recording medium is not limited to a DVD-ROM, a CD-ROM, an FD (Flexible Disk), or a hard disk, and it may be a medium that carries a program in a fixed manner, such as a magnetic tape, a cassette tape, an optical disk (MO (Magnetic Optical Disc)/MD (Mini Disc)/DVD (Digital Versatile Disc)), an optical card, or a semiconductor memory including a mask ROM, an EPROM (Electronically Programmable Read-Only Memory), an EEPROM (Electronically Erasable Programmable Read-Only Memory), a flash ROM, or the like. The recording medium is a non-transitory medium from which the computer can read the above-described program or the like.

The program herein includes, for example, a program directly executable by a CPU, as well as a program in a source program form, a compressed program, and an encrypted program.

[As to Calculation of Life of Photoconductor 2]

There is an increasing demand for longer life of an electrophotographic apparatus, and a photoconductor needs to have longer life correspondingly. Since the photoconductor is ground by a cleaning member, the film thickness of the photoconductor is the rate-determining factor that determines the life of the photoconductor. For longer life of the photoconductor, a photoconductor is proposed in which an irradiation portion irradiates the surface layer of the photoconductor with UV or electron rays to higher hardness.

However, grinding by the cleaning member has a small effect on the highly hardened photoconductor. Consequently, the film thickness is not the rate-determining factor that determines the life. An image forming apparatus including a highly hardened photoconductor thus cannot use life prediction or fault detection, which have been conventionally performed, based on a change in charge current associated with a reduction in the film thickness of the photoconductor.

Image forming apparatus 100 of the present embodiment calculates a post exposure potential without using a potential measurement device. Image forming apparatus 100 calculates the life of photoconductor 2 based on the post exposure potential Image forming apparatus 100 of the present embodiment controls its mode to any mode of a plurality of modes including an image formation mode and life detection mode. In the image formation mode, an image is formed on a sheet in accordance with a user's operation. In the life detection mode, whether "the end of the life of photoconductor 2 has been reached" or "an allowable operation amount of photoconductor 2" is determined. The allowable operation amount of photoconductor 2 is an operation amount of photoconductor 2 until it is determined that the end of the life of photoconductor 2 is reached. Image forming apparatus 100 switches the mode, for example, in accordance with an operation from operation unit 50.

Figure 3:
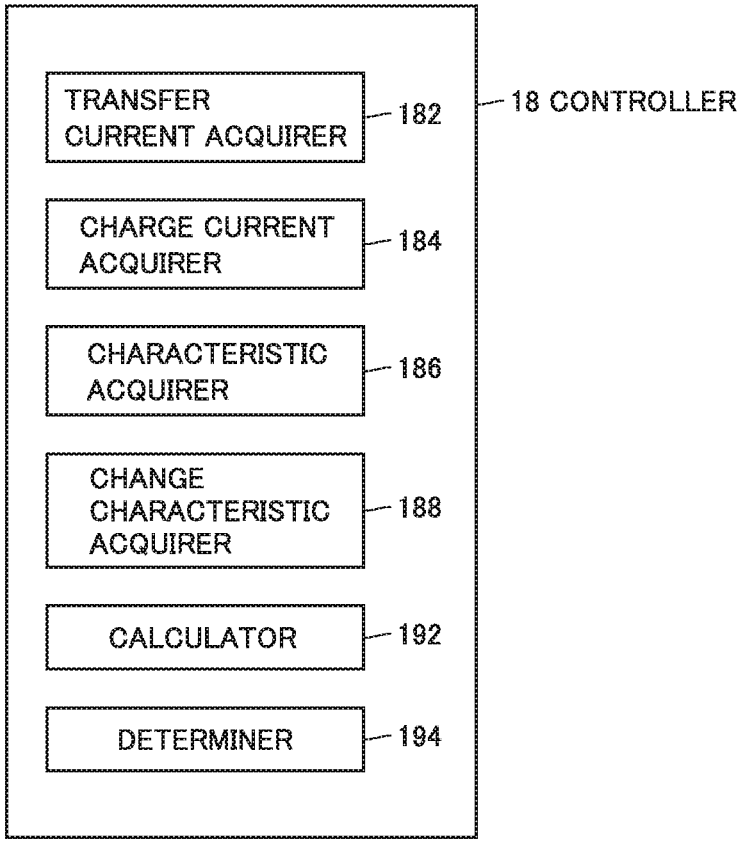
FIG. 3 shows an example functional configuration of a controller of an embodiment.
Figure 4:
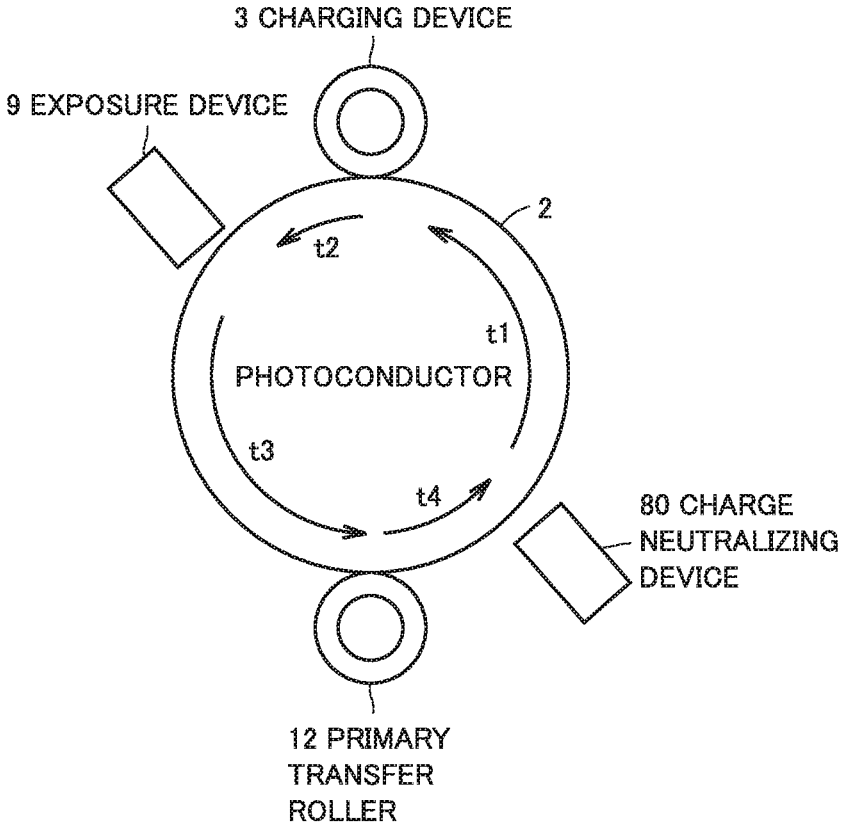
FIG. 4 shows an image forming unit of the embodiment.
Figure 5:
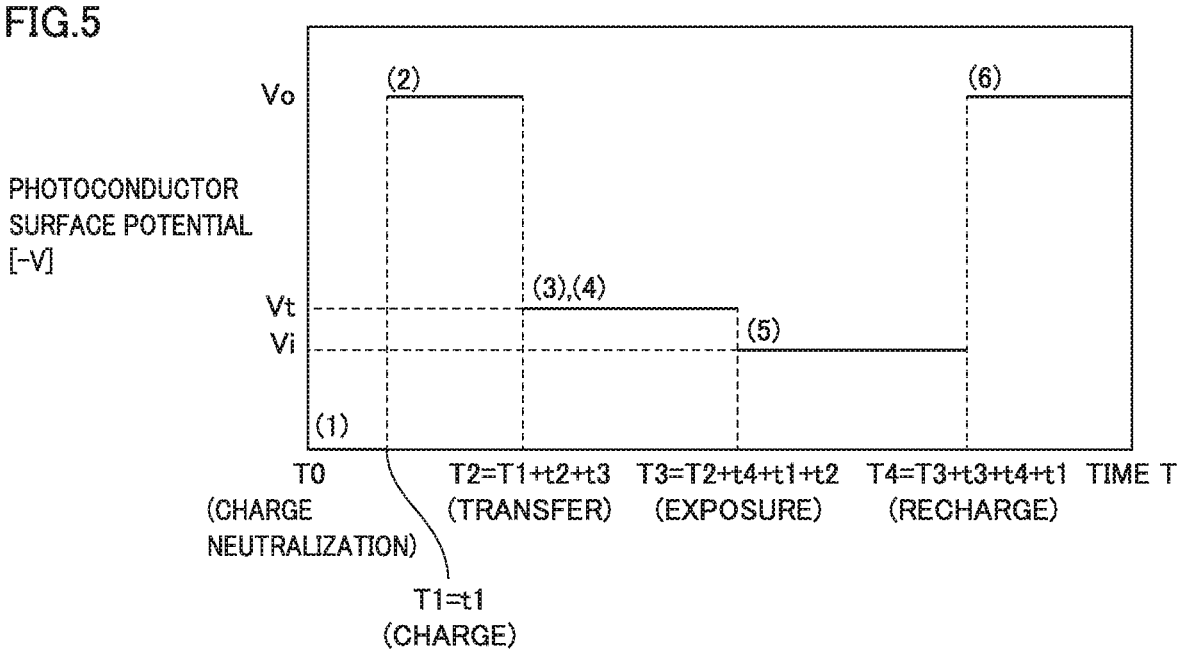
FIG. 5 shows changes in the surface potential of a photoconductor of the embodiment.
Figure 6:
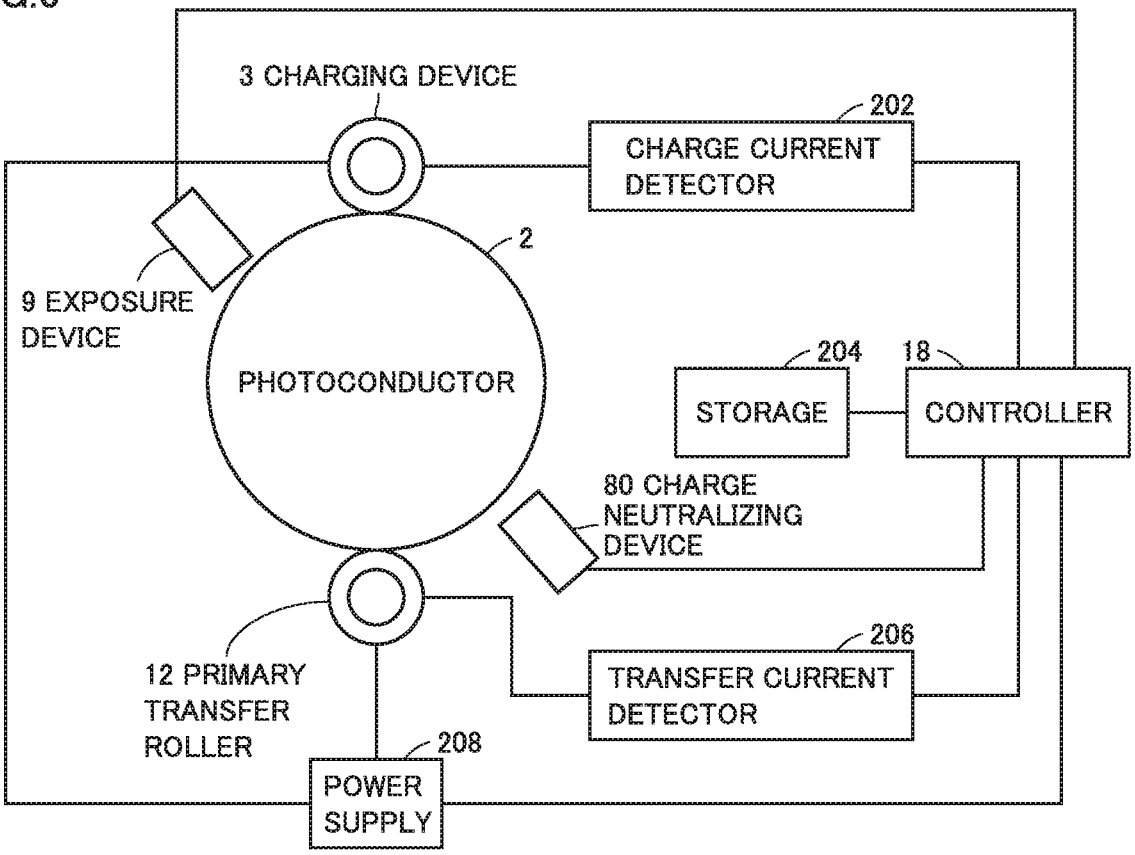
FIG. 6 shows the vicinity of the image forming device of the embodiment.

FIG. 3 shows an example functional configuration of controller 18 of the present embodiment. FIG. 4 shows the image forming device. FIG. 5 shows changes with time in the surface potential of photoconductor 2. FIG. 6 shows photoconductor 2 and a part of a component part of image forming apparatus 100. The processes in the life detection mode will be described with reference to FIGS. 3 to 6.

Times T of FIG. 5 are shown such that the charge neutralizing process by charge neutralizing device 80 is started at a timing T0. A time t1 represents a period of time until the counter portion facing charge neutralizing device 80 at timing T0 arrives at a nip portion of charging device 3 from the position at which the counter portion faces charge neutralizing device 80. The nip portion is a part at which charging device 3 and photoconductor 2 are in contact with each other. A time t2 represents a period of time until the counter portion arrives at exposure device 9 from the nip portion of charging device 3. A time t3 represents a period of time until the counter portion arrives at the nip portion of primary transfer roller 12 from exposure device 9. A time t4 represents a period of time until the counter portion arrives at charge neutralizing device 80 from the nip portion of primary transfer roller 12. As described above, a period of time required for photoconductor 2 to make one rotation is t1+t2+t3+t4.

At timing T0, first, charge neutralizing device 80 neutralizes a charge of (refreshes) photoconductor 2 before control in the life detection mode, as step (1). Through this charge neutralization, image forming apparatus 100 can eliminate an effect of the immediately preceding printing on photoconductor 2.

A timing T1 is a timing after time t1 has elapsed from timing T0. At timing T1, under the control of controller 18, power supply 208 applies a charge voltage Vc to charging device 3, as step (2). The surface potential of photoconductor 2 after the application is Vo (see FIG. 5).

A timing after a lapse of a time t2+t3 from timing T1 is a timing T2. At timing T2, under the control of controller 18, power supply 208 applies a transfer bias (transfer voltage) to primary transfer roller 12, as step (3). In the present embodiment, the transfer bias is a positive bias. Also, a current is supplied from primary transfer roller 12 to photoconductor 2. This lowers the surface potential of photoconductor 2 to Vt. A current flowing through primary transfer roller 12 upon application of a transfer bias is referred to as a "transfer current Itr". A transfer current detector 206 detects transfer current Itr. A transfer current acquirer 182 of controller 18 acquires the detected transfer current Itr. Transfer current Itr is a current when the counter portion passes through the nip portion of primary transfer roller 12 to which the transfer voltage has been applied.

When transfer current acquirer 182 acquires transfer current Itr, as step (4), controller 18 causes power supply 208 to stop the application of the charge voltage and the application of the transfer voltage. The application of the charge voltage is stopped because the counter portion needs to be moved to exposure device 9 while keeping the surface potential of photoconductor 2 after the measurement of transfer current Itr. The application of the transfer voltage is stopped because the counter portion needs to be moved from exposure device 9 to charging device 3 while keeping the surface potential of photoconductor 2 as described below.

A timing after a lapse of a time t4+t1+t2 from timing T2 is a timing T3. At timing T3, exposure device 9 exposes photoconductor 2 at the exposure intensity used in image formation (normal image formation process), as step (5).

The value (behavior) of the post exposure potential differs depending on the value of transfer current Itr supplied from primary transfer roller 12 at timing T2. As described below, image forming apparatus 100 of the present embodiment varies the transfer voltage in stages from 500 V to 2000 V in increments of 100 V, thus varying transfer current Itr as well. The value of the post exposure potential also varies by image forming apparatus 100 varying transfer current Itr.

Figure 7A:
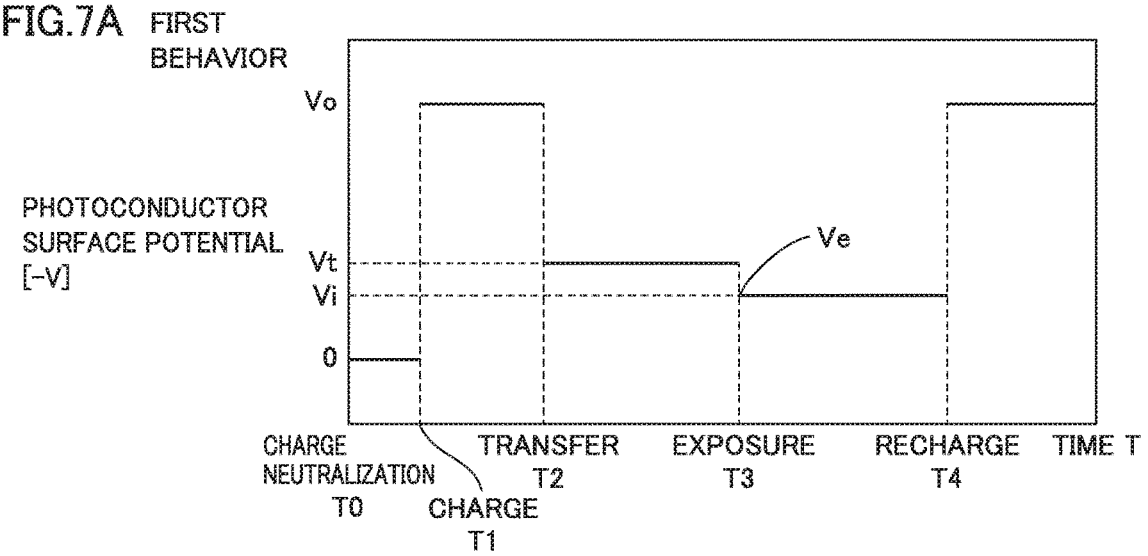
FIGS. 7A to 7C show three types of behaviors of a post exposure potential of the embodiment.
Figure 7B:
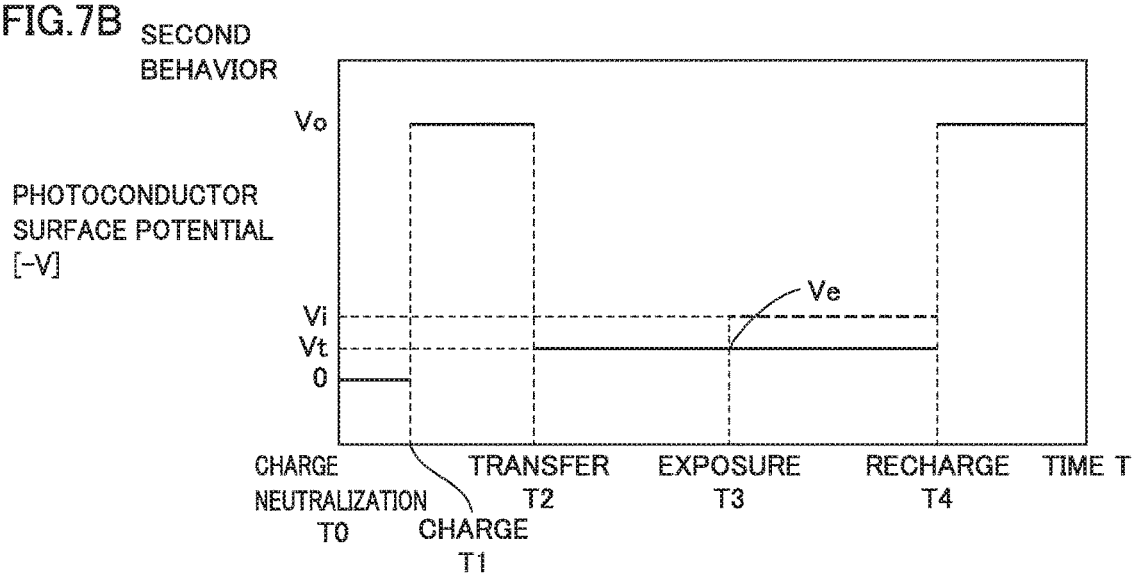
Figure 7C:
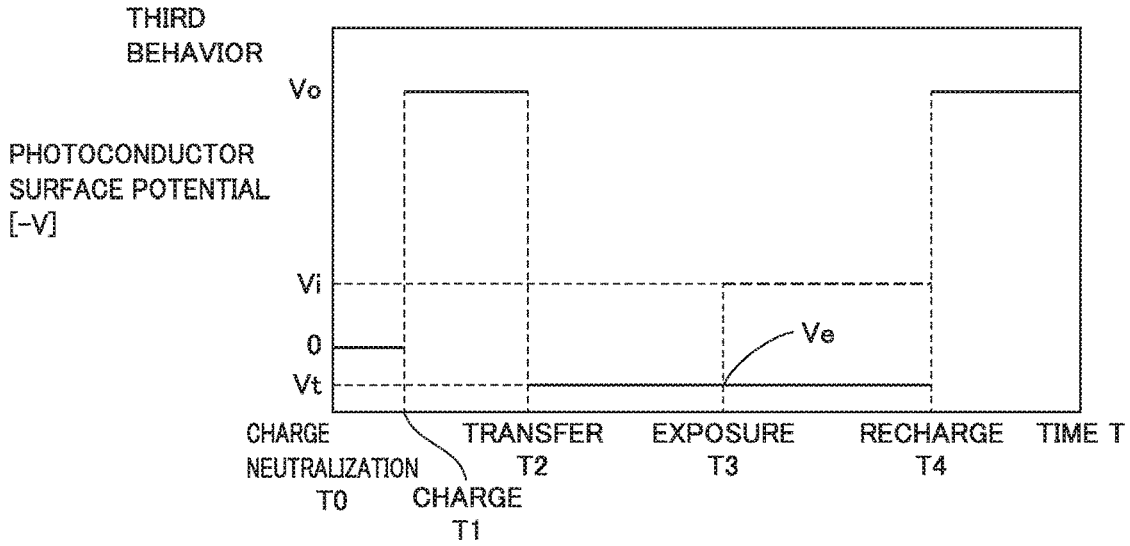

In the present embodiment, there are three behaviors of post exposure potential Ve. FIG. 7A shows a case in which post exposure potential Ve is a first value (first behavior), FIG. 7B shows a case in which post exposure potential Ve is a second value (second behavior), and FIG. 7C shows a case in which post exposure potential Ve is a third value (third behavior). A potential Vi is a design (theoretical) post exposure potential, which is a constant. Contrastingly, post exposure potential Ve is an actual potential after exposure, which is a variable changing in accordance with the value of transfer current Itr (transfer bias). In each of FIGS. 7A to 7C, the solid line represents the actual surface potential of photoconductor 2, and the dotted line represents post exposure potential Vi. FIG. 5 shows one example of FIG. 7A. As described below, the transfer bias is changed in stages. Transfer current Itr also changes along with the change in transfer bias. For example, transfer current Itr increases as the transfer bias increases.

The case in which post exposure potential Ve is the first value is a case of a low transfer current Itr, for example, a case in which $|Vt|>|Vi|$ and $Vt<0$ as shown in FIG. 7A. In this case, for example, the surface potential of photoconductor 2 drops to Vi through exposure. That is to say, Ve=Vi.

The case in which post exposure potential Ve is the second value is a case of a high transfer current Itr, for example, a case in which $|Vi|>|Vt|$ and $Vt<0$ as shown in FIG. 7B. In this case, the surface potential of photoconductor 2 does not become equal to or lower than the post exposure potential and does not change even when photoconductor 2 is exposed. That is to say, Ve=Vt.

The case in which post exposure potential Ve is the third value is a case of a transfer current Itr higher than that of FIG. 7B, for example, a case in which $Vt>0>Vi$ as shown in FIG. 7C. In this case, the surface potential of photoconductor 2 does not become equal to or lower than the post exposure potential and does not change even when photoconductor 2 is exposed. That is to say, Ve=Vt.

Next, a process at a timing T4 will be described. Timing T4 is a timing after a lapse of a time t3+t4+t1 from timing T3. At timing T4, charging device 3 charges photoconductor 2 again in order to return the surface potential of photoconductor 2 which has dropped through the transfer and the exposure to an initial potential (Vo), as step (6).

As shown in each of FIGS. 7A to 7C, post exposure potential Ve is any one of the first value to the third value (first behavior to third behavior) as described above.

Hereinbelow, an amount of a current flowing through charging device 3 when charging device 3 recharges photoconductor 2 is referred to as a charge current Ic. That is to say, charge current Ic is a current output when photoconductor 2 is charged. When post exposure potential Ve is as shown in FIG. 7A, Ve=Vi. The current amount required for returning the surface potential of photoconductor 2 from Vo to Vi is Ic. When $|Vt|>|Vi|$ is satisfied, if power supply 208 applies any transfer bias (if the transfer current is any current value) at timing T2, in the end, Ve=Vi. In the case of FIG. 7A, thus, charge current Ic flowing through charging device 3 is constant at timing T4.

When post exposure potential Ve is as shown in FIG. 7B, Ve=Vt. The current amount required for returning the surface potential of photoconductor 2 from Vt to Vo is Ic. When $|Vi|>|Vt|$ is satisfied, $|Vt|$ approaches to zero as transfer current Itr becomes higher, resulting in greater Ic. That is to say, Itr and Ic have a linear relationship (e.g., proportional relationship). For example, when a linear function with Itr represented by an X axis and Ic represented by a Y axis is graphically shown, the graph has a gradient α.

When post exposure potential Ve is as shown in FIG. 7C, Ve=Vi. The current amount required for returning the surface potential of photoconductor 2 from Vt to Vo is Ic. When Vt>0>Vi is satisfied, Vt becomes greater as transfer current Itr becomes higher. Itr and Ic thus have a linear relationship (e.g., proportional relationship). For example, when a linear function with Itr represented by an X axis and Ic represented by a Y axis is graphically shown, the graph has a gradient β.

When an amount of the transfer current is great, holes injected at the transfer current penetrate into a CTL (charge transport layer) of photoconductor 2. Thus, the surface of photoconductor 2 is not positively charged as much as an injection amount of transfer current Itr. The current amount required for reducing the potential from Vt to zero is thus smaller than the current amount required for reducing the potential from zero to −Vt. The characteristic shown in FIG. 7C thus has a gradient smaller than that of the characteristic shown in FIG. 7B. That is to say, gradient α>gradient β.

Even in any case of FIGS. 7A to 7C, a charge current acquirer 202 measures charge current Ic. A charge current acquirer 184 acquires the measured charge current Ic.

Based on the control of power supply 208 by controller 18, controller 18 changes the transfer bias in stages. In the present embodiment, controller 18 changes, for example, the transfer bias in stages from 500 V to 2000 V in increments of 100 V. That is to say, in the present embodiment, the number of stages of the transfer bias is "16 stages". For example, charge voltage Vc=−800 V, and the exposure intensity by exposure device 9 is 1.8 mJ/$m^2$.

Respective transfer currents Itr (currents acquired by transfer current acquirer 182) at the transfer potentials changed in 16 stages are stored in a predetermined region (e.g., RAM 103). Hereinbelow, these transfer currents will be referred to as "16 transfer currents Itr".

Respective charge currents Ic (currents acquired by charge current acquirer 184) at the transfer biases changed in stages are stored in the predetermined region (e.g., RAM 103). Hereinbelow, these charge currents will be referred to as "16 charge currents Ic".

A characteristic acquirer 186 acquires the characteristics of the charge current and transfer current based on "16 transfer currents Itr" and "16 charge currents Ic" stored in the predetermined region. That is to say, the transfer voltage is changed in a plurality of stages, and characteristic acquirer 186 acquires the characteristics based on the transfer current and charge current in each of the plurality of stages.

Figure 8:
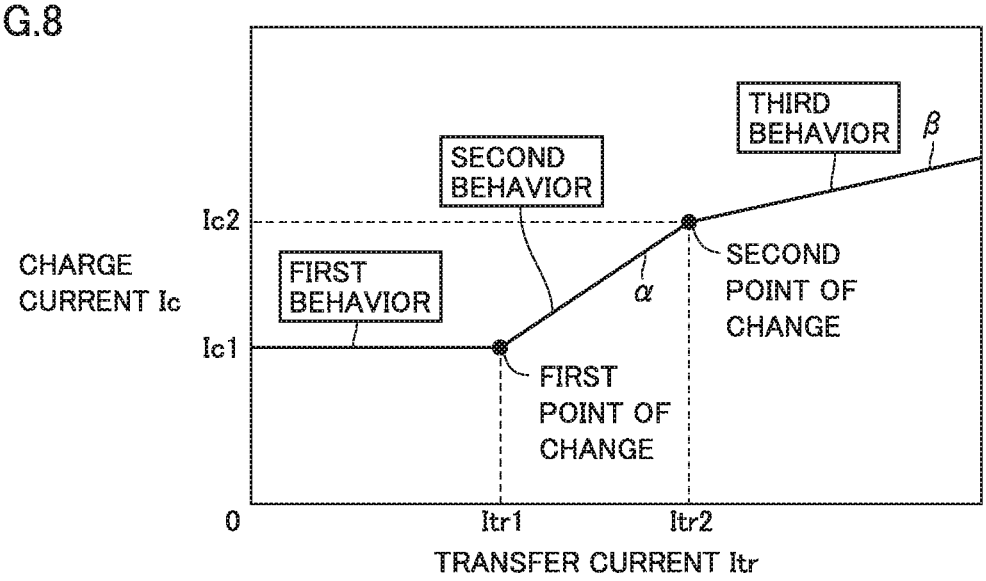
FIG. 8 shows a first point of change and a second point of change.

FIG. 8 shows the characteristics. In FIG. 8, the X axis (horizontal axis) represents transfer current Itr, and the Y axis (vertical axis) represents charge current Ic. The graph of FIG. 8 is based on 16 transfer currents and 16 charge currents. Although the graph of FIG. 8 is created in a linear manner, in actuality, the graph of FIG. 8 is created by connecting 16 plots (dots).

As described above, post exposure potential Ve exhibits any behavior of the first behavior to the third behavior. In the case of the first behavior, charge current Ic is constant irrespective of the value of transfer current Itr, as described above. In the case of the second behavior, charge current Ic and transfer current Itr have a linear relationship (e.g., proportional relationship). In the case of the third behavior, charge current Ic and transfer current Itr have a linear relationship (e.g., proportional relationship), and the gradient is smaller than that of the second behavior. FIG. 8 shows a graph reflecting the relationship between charge current Ic and transfer current Itr in each of the first behavior to the third behavior.

A change characteristic acquirer 188 acquires a change amount of the gradient at each point of measurement (Itr, Ic) from the Itr-Ic characteristics (the graph of FIG. 8). When the calculated change amount of the gradient at each point of measurement (Itr, Ic) belongs to a first range, the point of measurement is a first point of change. α belongs to the first range. The first point of change may be a point at which the change amount of the ratio of transfer voltage to transfer current is a first value (e.g., α). When the calculated change amount of the gradient at each point of measurement (Itr, Ic) belongs to a second range, the point of measurement is a second point of change. α-β (a value obtained by subtracting β from α) belongs to the second range. The second point of change may be a point at which the change amount of the ratio of transfer voltage to transfer current is a second value (e.g., α-β). The second value is smaller than the first value.

In the example of FIG. 8, the gradient when post exposure potential Ve exhibits the first behavior is "0", and the gradient when post exposure potential Ve exhibits the second behavior is "α". Since α belongs to the first range, the point at which the gradient changes from "0" to "α" is the first point of change. The gradient when post exposure potential Ve exhibits the second behavior is "α", and the gradient when post exposure potential Ve exhibits the third behavior is "α-β". Since α-β belongs to the second range, the point at which the gradient changes from "α" to "α-β" is the second point of change.

Alternatively, the first point of change may be a point at which the gradient changes from a minimum value (zero in the example of FIG. 8) to a maximum value (α in the example of FIG. 8). Also, the second point of change may be a point at which the gradient changes from the maximum value (α in the example of FIG. 8) to the second greatest value (β in the example of FIG. 8).

Description has been given assuming that in the example of FIG. 8, image forming apparatus 100 uses the characteristics of the transfer current and the charge current. Alternatively, image forming apparatus 100 may use the characteristics of the transfer bias and the charge current in a modification.

When charge voltage Vc=−800 V in recharging, change characteristic acquirer 188 acquires the first point of change and the second point of change.

Then, change characteristic acquirer 188 changes charge voltage Vc in recharging and performs the above process, thereby acquiring the first point of change and the second point of change again. For example, charge voltage Vc=−1000 V, Vc1=−800 V, and Vc2=−1000 V. That is to say, in the present embodiment, change characteristic acquirer 188 acquires the first point of change and the second point of change when charge voltage Vc=−800 V in recharging and also acquires the first point of change and the second point of change when charge voltage Vc=−1000 V in recharging. In the present embodiment, two types (−800 V and −1000 V) of transfer voltages Vc are changed, as described above. In a modification, three or more types of transfer voltages Vc may be changed.

Figure 9:
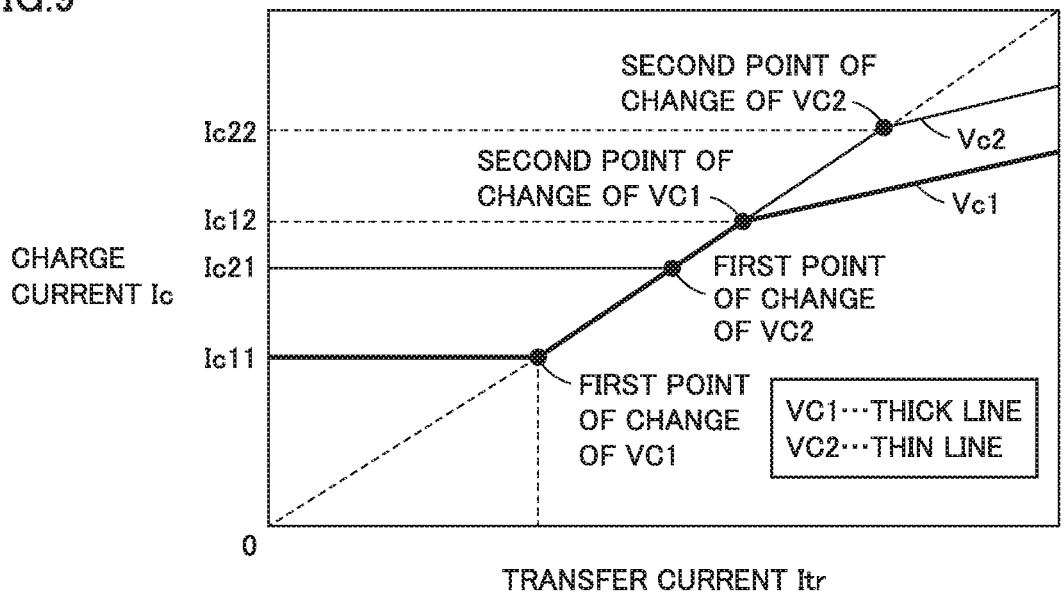
FIG. 9 shows a relationship between charge current and transfer current.

FIG. 9 shows the first point of change and the second point of change when charge voltage Vc=−800 V and the first point of change and the second point of change when charge voltage Vc=−1000 V in recharging. In the example of FIG. 9, the graph shifts upward as charge voltage Vc in recharging is higher (at charge voltage Vc=−1000 V than at charge voltage Vc=−800 V).

In FIG. 9, Ic corresponding to the first point of change and Ic corresponding to the second point of change at Vc1 are Ic11 and Ic12, respectively. Ic corresponding to the first point of change and Ic corresponding to the second point of change at Vc2 are Ic21 and Ic22, respectively.

"Ic11, Ic12" for Vc1 and "Ic21, Ic22" for Vc2 are each stored in the predetermined region (e.g., RAM 103). As described above, change characteristic acquirer 188 changes the charge voltage in a plurality of stages (in the present embodiment, two stages in which the charge potential is Vc1 and Vc2) and acquires a plurality of first change characteristics and a plurality of second change characteristics.

Then, a calculator 192 calculates post exposure potential Vi. A way of calculating post exposure potential Vi will be described below. Calculator 192 calculates post exposure potential Vi based on "Ic11, Ic12" for Vc1 and "Ic21, Ic22" for Vc2 which are stored in the predetermined region. Calculator 192 first obtains the relationship between Ic and Vc at the first point of change and the second point of change based on these values.

Figure 10:
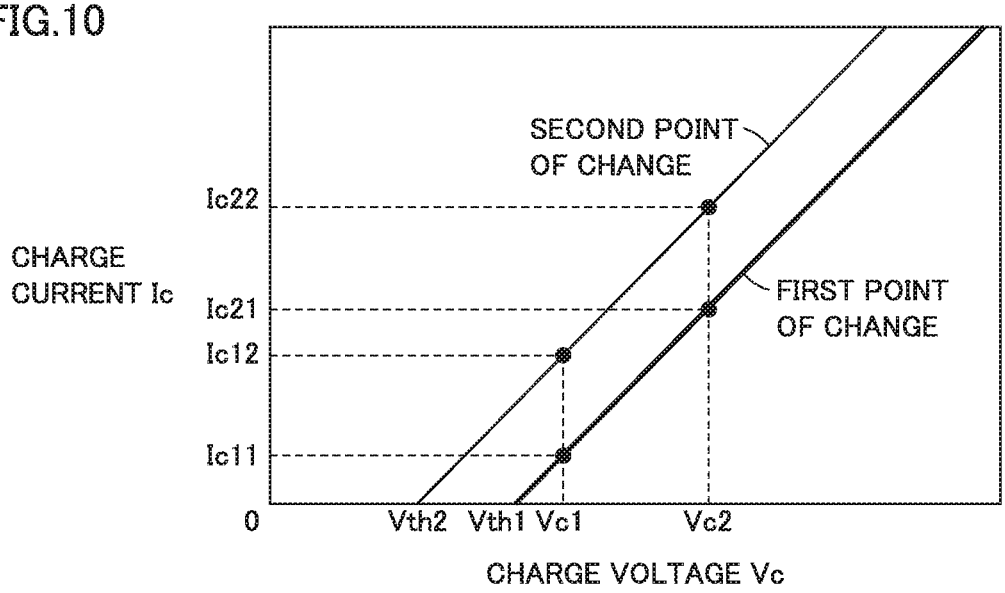
FIG. 10 shows a relationship between charge current and transfer voltage.

FIG. 10 shows a relationship between Ic and Vc (Ic-Vc characteristics). FIG. 10 shows a graph in which the vertical axis (X axis) represents charge voltage Vc and the vertical axis (Y axis) represents charge current Ic. The thick solid line is a graph showing the first point of change when Vc is Vc1 and Vc2. The thin solid line is a graph showing the second point of change when Vc is Vc1 and Vc2.

Herein, also as shown in FIGS. 7A to 7C, the first point of change is a point of change that appears when post exposure potential Vi changes from the first behavior to the second behavior, that is, when Vt satisfying Vt>Vi reaches Vi (Vt=Vi). It can thus be said that Ic corresponding to the first point of change is a current amount required for changing the surface potential of photoconductor 2 from Vi to Vo, and Vc corresponding to the first point of change is a charge voltage required for changing the surface potential of photoconductor 2 from Vi to Vo.

The second point of change is a point of change that appears when post exposure potential Vi changes from the second behavior to the third behavior, that is, when Vt satisfying Vt=Vi reaches zero (Vt=0). It can thus be said that Ic corresponding to the second point of change is a current amount required for changing the surface potential of photoconductor 2 from zero to Vo, and Vc corresponding to the second point of change is a charge voltage required for changing the surface potential of photoconductor 2 from zero to Vo.

At the first point of change (thick solid line in FIG. 10), Vc at Ic=0 is a voltage Vth1 (hereinafter, discharge start voltage Vth1) at which discharge starts. This is based on the fact that discharge occurs only after a current flows through charging device 3. Thus, representation by an expression Vc=Vo-Vi+Vth1 in FIG. 10 is obtained for Ic-Vc characteristics.

At the second point of change (thin solid line in FIG. 10), Vc at Ic=0 is a discharge start voltage Vth2. Thus, representation by an expression Vc=Vo+Vth2 in FIG. 10 is obtained for Ic-Vc characteristics.

Since Vc is common, a relational expression Vo−Vi+Vth1=Vo+Vth2 holds. From this relational expression, Vi=Vth1−Vth2 (Vi is a value obtained by subtracting Vth2 from Vth1). Vi=Vth1−Vth2 is referred to as a "voltage calculation expression". Since the Ic-Vc characteristics have linearity, representation by an expression is obtained if there are two or more points of (Ic, Vc) (combinations of Ic and Vc). Calculator 192 can thus determine discharge start voltages Vth1 and Vth2. Calculator 192 can accordingly obtain discharge start voltage Vth1 and discharge start voltage Vth2 for each point of change (first point of change and second point of change), thus calculating post exposure potential Vi. If the environment of the calculation of post exposure potential Vi is not a reference environment (e.g., if humidity is extremely low), calculator 192 may apply (may multiply) a correction coefficient in order to convert post exposure potential V1 to the value in the reference environment.

As described above, calculator 192 calculates post exposure potential Vi based on six parameters, namely, first to sixth parameters, as shown in FIG. 10. The first parameter is first charge voltage Vc1. The second parameter is second charge voltage Vc2.

The third parameter is charge current Ic11 in the first change characteristic (first point of change) when the charge voltage is first charge voltage Vc1. The fourth parameter is charge current Ic12 in the second change characteristic (second point of change) when the charge voltage is first charge voltage Vc1. The fifth parameter is charge current Ic21 in the first change characteristic (first point of change) when the charge voltage is second charge voltage Vc2. The sixth parameter is charge current Ic22 in the second change characteristic (first point of change) when the charge voltage is second charge voltage Vc2.

In other words, calculator 192 calculates the post exposure potential based on the first charge voltage, the second charge voltage, the charge current in the first change characteristic when the charge voltage is the first charge voltage, the charge current in the second change characteristic when the charge voltage is the first charge voltage, the charge current in the first change characteristic when the charge voltage is the second charge voltage, and the charge current in the second change characteristic when the charge voltage is the second charge voltage.

As described above, the image forming apparatus of the present embodiment can calculate the post exposure potential using the first to sixth parameters without the use of a potential measurement device. The present embodiment has been described assuming that the number of Vc's to be changed is "2", that is, assuming that image forming apparatus 100 calculates the post exposure potential based on the graphs of FIGS. 9 and 10 in the case of Vc=−800 V and the case of Vc=−1000 V. Alternatively, the number of Vc's to be changed may be "3" or more. In this case, image forming apparatus 100 can calculate a more accurate post exposure potential by providing a more accurate graph in FIGS. 9 and 10. Next, a technique of calculating the life of photoconductor 2 will be described using the post exposure potential.

A determiner 194 compares a predetermined threshold Vith with a post exposure potential Vi calculated by calculator 192. Threshold Vith is a predetermined value. Threshold Vith is an upper limit of post exposure potential Vi in photoconductor 2. When post exposure potential Vi is more than or equal to threshold Vith, image noise (memory) is caused upon printing of an image on a sheet. Threshold Vith is, for example, −200 V. Thus, post exposure potential Vi needs to be less than threshold Vith such that image forming apparatus 100 performs an image formation process without causing image noise.

When determiner 194 has determined that post exposure potential Vi≥threshold Vith, image noise is caused if image forming apparatus 100 performs the image formation process at the unchanged exposure intensity. In order to prevent the generation of the image noise, thus, controller 18 controls exposure intensity change of exposure device 9. For example, controller 18 increases the exposure intensity as exposure intensity change control. Image forming apparatus 100 can prevent the generation of image noise by performing the exposure intensity change control. When it is determined that post exposure potential Vi≥threshold Vith, controller 18 determines whether the exposure intensity is a maximum exposure intensity.

When it is determined that the exposure intensity is the maximum exposure intensity (e.g., 3.3 $mJ/m^2$), controller 18 cannot increase the exposure intensity, and accordingly, determiner 194 determines that the end of the life of photoconductor 2 has been reached. Contrastingly, when it is determined that the exposure intensity is not the maximum exposure intensity, determiner 194 obtains an appropriate exposure intensity at which image noise is not caused.

Figure 11:
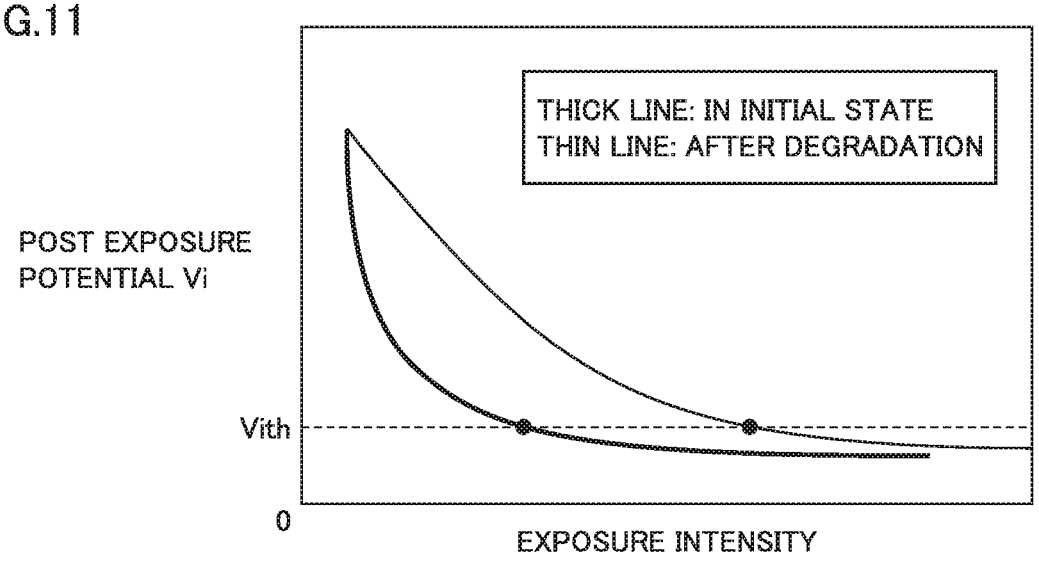
FIG. 11 shows a relationship between exposure intensity and post exposure potential.

FIG. 11 shows a relationship between exposure intensity and post exposure potential Vi. The example of FIG. 11 shows this relationship when photoconductor 2 is in the initial state and when photoconductor 2 is in the degraded state. As shown in FIG. 11, at the same exposure intensity, photoconductor 2 in the degraded state is likely to have post exposure potential Vi higher than that of photoconductor 2 in the initial state. In the present embodiment, the exposure intensity is 1.8 $mJ/m^2$ as described above. When it is determined that the exposure intensity is not a maximum exposure intensity, controller 18 changes the exposure intensity such that post exposure potential Vi is equal to threshold Vith.

For example, controller 18 increases the current exposure intensity by an amount of a smallest-unit exposure intensity. The smallest-unit exposure intensity is, for example, 0.5 $mJ/m^2$. Calculator 192 calculates post exposure potential Vi using Vth1 and Vth2 at the increased exposure intensity by the amount of the smallest-unit exposure intensity, and determiner 194 compares the calculated post exposure potential Vi with threshold Vith. Through this comparison, controller 18 increases the exposure intensity in increments of the smallest-unit exposure intensity until post exposure potential Vi<threshold Vith.

Even when the exposure intensity has reached the maximum exposure intensity, if it is determined that the calculated post exposure potential Vi is more than or equal to threshold Vith, determiner 194 determines that the end of the life of photoconductor 2 has been reached. When it is determined that the end of the life of photoconductor 2 has been reached, controller 18 performs life process. The life process includes, for example, a process of transmitting life information to a management device (not shown) communicably connected to the image forming apparatus. The life information indicates that photoconductor 2 has reached the end of its life. The image forming apparatus transmits the life information to the management device, thereby causing a repair person of the image forming apparatus to recognize that photoconductor 2 has reached the end of its life. The image forming apparatus may display on display 1051 that photoconductor 2 has reached the end of its life. The image forming apparatus may output a predetermined notification sound from speaker 106. Through these processes, the image forming apparatus can cause the user to recognize that photoconductor 2 has reached the end of its life.

Figure 12:
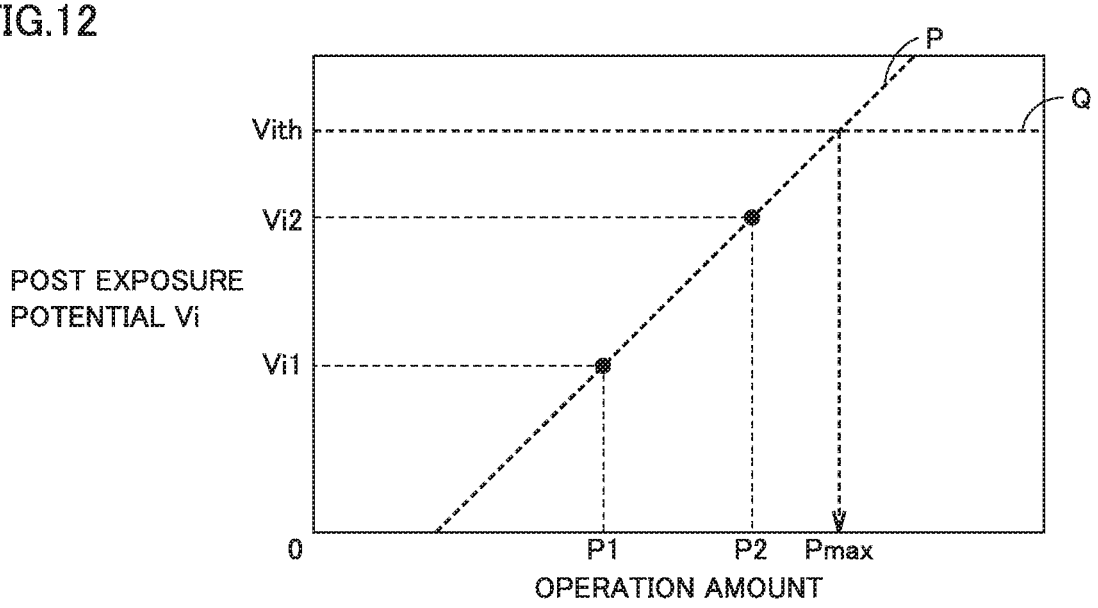
FIG. 12 shows a relationship between a post exposure potential and an operation amount of a photoconductor.

When it is determined that post exposure potential Vi<threshold Vith, controller 18 calculates the life of photoconductor 2. FIG. 12 shows a relationship between an operation amount P of photoconductor 2 and post exposure potential Vi. The operation amount includes at least one of the rotation number of photoconductor 2 and the number of printed sheets. When calculator 192 performs a process of calculating post exposure potential Vi, the operation amount of photoconductor 2 is stored in the predetermined region (e.g., RAM 103).

The example of FIG. 12 shows operation amount P and post exposure potential Vi at two points for brevity's sake. For example, a current operation amount is represented by P2, and a post exposure potential calculated with the operation amount P2 is represented by Vi2. The operation amount before calculation of post exposure potential Vi2 is represented by P1, and the post exposure potential calculated with operation amount P1 is represented by Vi1.

An intersection point of a straight line P connecting two points, namely, (P1, Vi1) and (P2, Vi2) and a straight line Q of Vi=Vimax is represented by a maximum operation amount Pmax. Vimax is a predetermined numeric value. Maximum operation amount Pmax is the operation amount by which the end of the life of photoconductor 2 has been reached. Also as described with reference to FIG. 11, photoconductor 2 after being degraded (i.e., photoconductor 2 with a greater operation amount) is likely to have post exposure potential Vi higher than that of photoconductor 2 in the initial state (i.e., photoconductor 2 with a smaller operation amount).

For example, determiner 194 performs a calculation process in accordance with an expression Pmax-P2 (a value obtained by subtracting P2 from Pmax) using the calculated maximum operation amount Pmax. Based on this expression, determiner 194 can recognize how much photoconductor 2 will operate before the arrival of the end of the life of photoconductor 2. Determiner 194 may transmit an operation amount of photoconductor 2 before the arrival of the end of the life of photoconductor 2 (hereinafter, also referred to as a first allowable operation amount) to the management device, thereby causing the repair person of the image forming apparatus to recognize such an operation amount. Alternatively, determiner 194 may cause display 1051 to display the operation amount, thereby causing the user to recognize the operation amount.

As described above, determiner 194 determines, for example, "whether the end of the life of photoconductor 2 has been reached" and "how much photoconductor 2 will operate before the arrival of the end of the life of photoconductor 2". Determiner 194 makes a determination as to the life of photoconductor 2 based on the post exposure potential.

[Flow in Life Detection Mode]

A flow of the process in the life detection mode will be described with reference to FIG. 13. First, at step S1 (step (1) described above), charge neutralizing device 80 neutralizes the charge of (refreshes) photoconductor 2. Then, at step S2 (step (2) as described above), power supply 208 applies charge voltage Vc to charging device 3. At step S3 (step (3) as described above), transfer current acquirer 182 acquires the detected transfer current Itr.

Then, at step S4 (step (4) described above), controller 18 causes power supply 208 to stop the application of the charge voltage and the application of the transfer voltage. Then, at step S5 (step (5) described above), exposure device 9 exposes photoconductor 2 at the exposure intensity used in image formation (normal image formation process). Then, at step S6 (step (6) as described above), power supply 208 applies charge voltage Vc to charging device 3 again. Charge current acquirer 184 acquires charge current Ic in this application.

Then, at step S7, controller 18 determines whether all the transfer voltages have been changed. In the present embodiment, the transfer voltage is a voltage from 500 V to 2000 V in increments of 100 V.

If the determination is NO at step S7, image forming apparatus 100 changes the transfer voltage of 100 V and repeats the processes of steps S1 to S7 again. If the determination is YES at step S7, the process proceeds to step S9.

At step S9, characteristic acquirer 186 acquires the first point of change and the second point of change (see FIG. 8). Then, at step S10, controller 18 determines whether all the transfer voltages have been changed. In the present embodiment, all the transfer voltages are two types of voltages, −800 V and −1000 V.

If the determination is NO at step S10, at step S11, image forming apparatus 100 changes the charge voltage and repeats the processes of steps S1 to S10. Change characteristic acquirer 188 acquires the first point of change and the second point of change at each of a transfer voltage of −800 V and a transfer voltage of −1000 V.

At step S12, calculator 192 acquires Ic-Vc characteristics (see FIG. 10) corresponding to the first point of change and the second point of change. At step S13, calculator 192 calculates post exposure potential Vi from the acquired Ic-Vc characteristics (using the first to sixth parameters described above).

At step S14, determiner 194 determines whether post exposure potential Vi calculated at step S13 is less than threshold Vith. If the determination is NO at step S14, the process proceeds to step S16.

At step S16, determiner 194 determines whether the exposure intensity is its maximum when post exposure potential Vi is calculated (i.e., when the process of step S13 is performed). When the determination is NO at step S16, the process proceeds to step S17.

At step S17, controller 18 increases the exposure intensity by an amount of the minimum-unit exposure intensity (0.5 $mJ/m^2$ in the present embodiment). Subsequently, controller 18 repeats the processes of steps S1 to S16. When the determination is YES in the process of step S16, controller 18 advances control to step S18. At step S18, determiner 194 determines that the end of the life of photoconductor 2 has been reached. When it is determined that the end of the life of photoconductor 2 has been reached, controller 18 performs the life process and ends the process mode.

At step S15, controller 18 calculates the life based on the calculated post exposure potential Vi. For example, at step S15, determiner 194 performs a computation of Pmax-P2 to calculate the first allowable operation amount, as described with reference to FIG. 12. When the process of step S17 has been performed, if it is determined that post exposure potential Vi calculated again is less than threshold voltage Vith (YES at step S14), the exposure intensity changed in the process of step S17 is stored in the predetermined region (e.g., RAM 103). Subsequently, when image forming apparatus 100 performs the image formation process, exposure device 9 exposes photoconductor 2 at the exposure intensity stored in the predetermined region.

[Effects Achieved by Image Forming Apparatus of the Present Embodiment]

Figure 13:
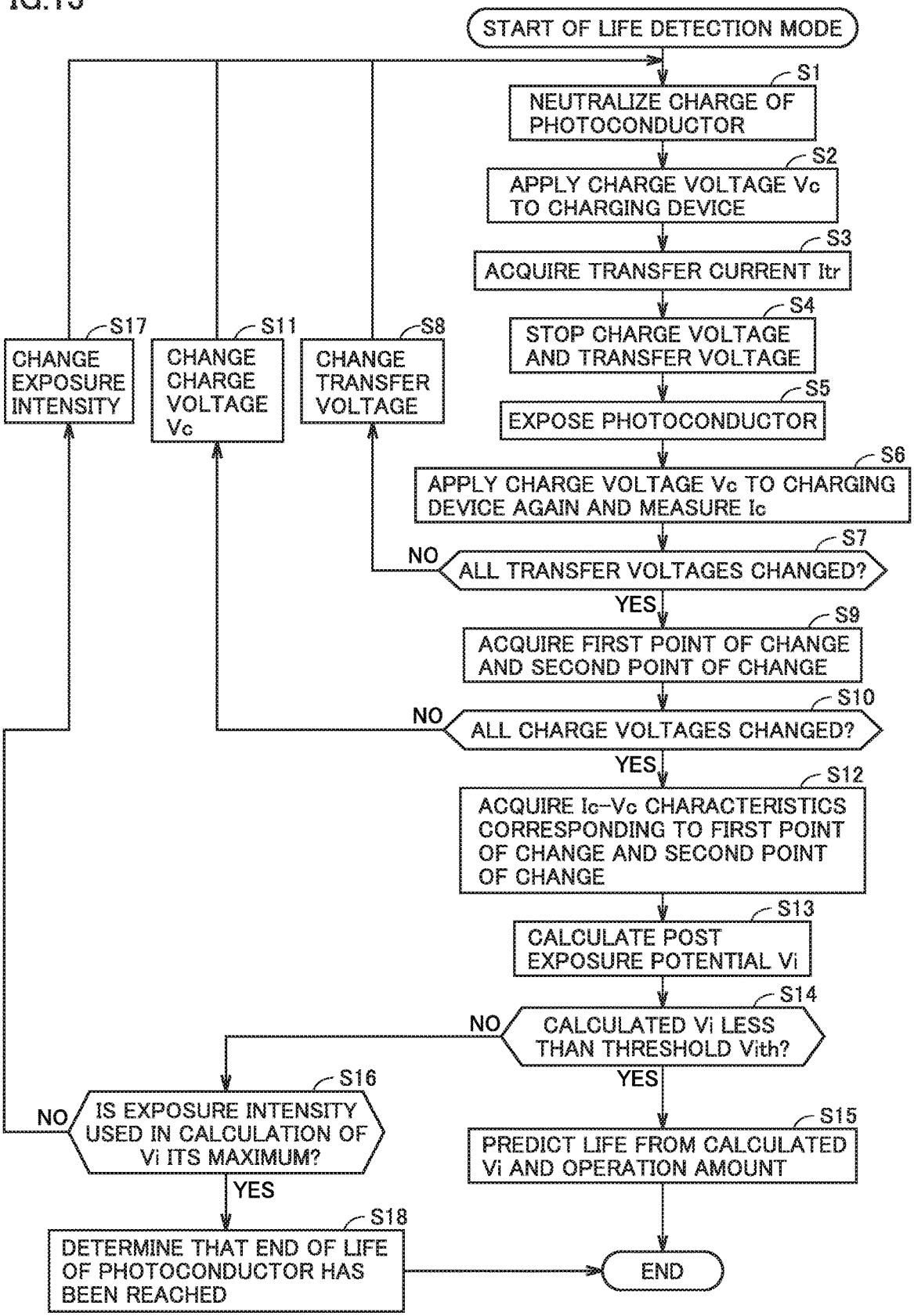
FIG. 13 is a flowchart in life detection mode.

(1) Image forming apparatus 100 of the present embodiment calculates post exposure potential Vi using the six parameters described above (see FIG. 10 and step S13 of FIG. 13). Further, determiner 194 makes a determination as to the life of photoconductor 2 based on post exposure potential Vi (see steps S15 and S18 of FIG. 13). Image forming apparatus 100 can thus make a determination as to the life of photoconductor 2 without the use of the potential measurement device that measures the potential after exposure. Image forming apparatus 100 of the present embodiment can thus make a determination as to the life of photoconductor 2 at low cost.

(2) As described with reference to FIG. 8 or the like, the first point of change is a point at which a change amount of the ratio (gradient) of the charge voltage to the transfer current is a first value ($\alpha$). Also, the second point of change is a point at which the change amount of the ratio (gradient) of the charge voltage to the transfer current is a second value ($\alpha$-$\beta$). Thus, image forming apparatus 100 can appropriately obtain post exposure potential Vi.

(3) At step S14 of FIG. 13, determiner 194 determines whether post exposure potential Vi is greater than threshold voltage Vith. When determiner 194 determines at step S14 that post exposure potential Vi is higher than threshold voltage Vith (YES at step S14), a change process of changing the exposure intensity of the exposure device is performed (see step S17). Also, calculator 192 calculates post exposure potential Vi again at the exposure intensity changed at step S17 (after the process of step S17 is complete, calculator 192 calculates post exposure potential Vi again at step S13). Further, the change process (step S17) and the process (step S13) of calculating post exposure potential Vi again by calculator 192 are repeated until post exposure potential Vi calculated again is less than or equal to threshold voltage Vith.

Such a configuration allows the image forming apparatus to perform the image formation process at the exposure intensity at which post exposure potential Vi is less than threshold voltage Vith. Consequently, a period in which the end of the life of photoconductor 2 will be reached can be delayed.

(4) When the exposure intensity has reached its maximum exposure intensity through the change process of step S17 (YES at step S16), if it is determined that post exposure potential Vi calculated again is greater than threshold voltage Vith (NO at step S14), determiner 194 determines that the end of the life of photoconductor 2 has been reached at step S18. Consequently, image forming apparatus 100 can appropriately determine that the end of the life of photoconductor 2 has been reached.

(5) Image forming apparatus 100 includes the image forming device (secondary transfer roller 13) that forms an image on a sheet. When the process of step S17 has been performed, if it is determined that post exposure potential Vi calculated again is less than threshold voltage Vith (YES at step S14), the exposure intensity changed in the process of step S17 is stored in the predetermined region (e.g., RAM 103). Subsequently, when image forming apparatus 100 performs the image formation process, exposure device 9 exposes photoconductor 2 at the exposure intensity stored in the predetermined region. In other words, when determiner 194 determines that post exposure potential Vi calculated again is less than threshold voltage Vith, exposure device 9 exposes photoconductor 2 such that the image forming device (secondary transfer roller 13) forms an image on a sheet at the exposure intensity at the time of the determination. Thus, with post exposure potential Vi less than threshold voltage Vith, that is, with no image noise caused, image forming apparatus 100 can perform the image formation process.

(6) As shown in FIG. 12, determiner 194 calculates maximum operation amount Pmax based on a current post exposure potential Vi2, a current operation amount P2, a previous post exposure potential Vi1 (previous post exposure potential), and a previous operation amount P1 (an operation amount in the calculation of the previous post exposure potential). Further, determiner 194 calculates the first allowable operation amount based on maximum operation amount Pmax. Determiner 194 computes, for example, Pmax-P2 to calculate the first allowable operation amount. This allows determiner 194 to recognize how much photoconductor 2 will operate before the arrival of the end of the life of photoconductor 2.

(7) As shown in FIG. 4, image forming apparatus 100 includes charge neutralizing device 80. Charge neutralizing device 80 neutralizes a charge of photoconductor 2 before being charged by charging device 3. Thus, even when the printing process has been performed before this charging, an effect of the printing process (e.g., remaining voltage) can be eliminated. Image forming apparatus 100 can thus appropriately calculate post exposure potential Vi.

[Modification]

A modification of the image forming apparatus of the present embodiment will now be described.

(1) Description has been given assuming that the image forming apparatus of the present embodiment includes charge neutralizing device 80. Alternatively, the image forming apparatus may include no charge neutralizing device and cause another component part, for example, exposure device 9 to perform charge neutralization. For example, exposure device 9 may expose (neutralize a charge of) photoconductor 2 at the voltage having the intensity of charge neutralizing device 80. Such a configuration causes the exposure device to also function as a charge neutralizing device, leading to a reduced number of parts.

(2) In the configuration including charge neutralizing device 80, charge neutralizing device 80 may perform the exposure process of exposure device 9 in the life detection mode. In other words, charge neutralizing device 80 performs the same process as that of the charging device. In the present modification, exposure device 9 does not perform the exposure process in the life detection mode. For example, charge neutralizing device 80 performs charge neutralization at the same intensity as the exposure intensity of exposure device 9 of the present embodiment. In the present modification, since exposure device 9 is used in the image formation mode, image forming apparatus 100 preferably includes exposure device 9.

Figure 14:
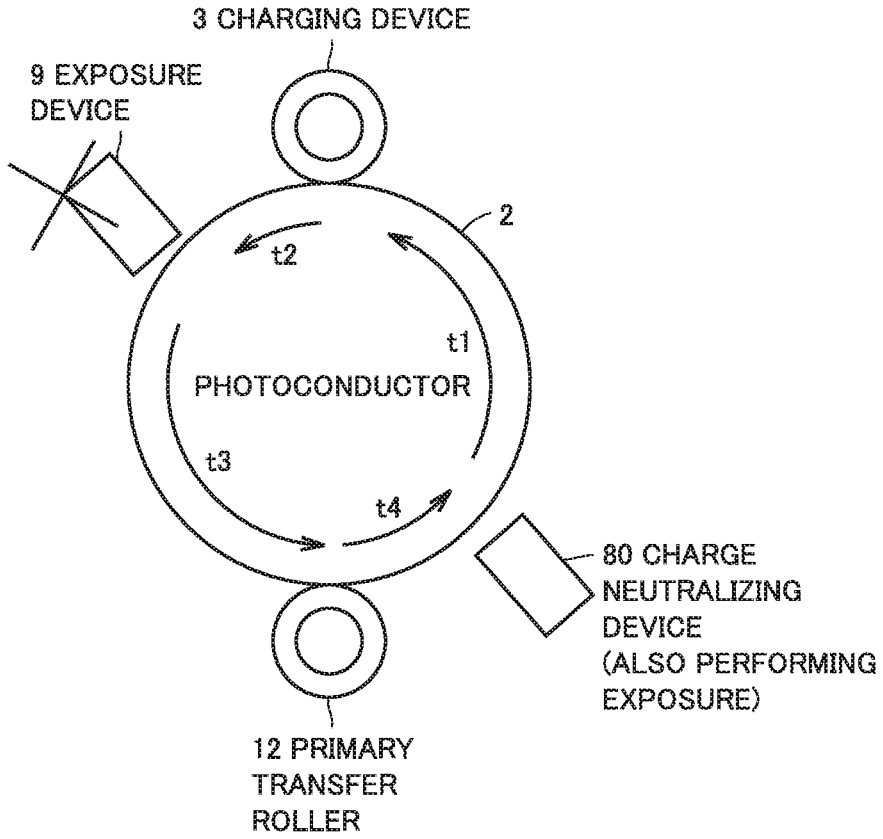
FIG. 14 shows an image forming unit of a modification.
Figure 15:
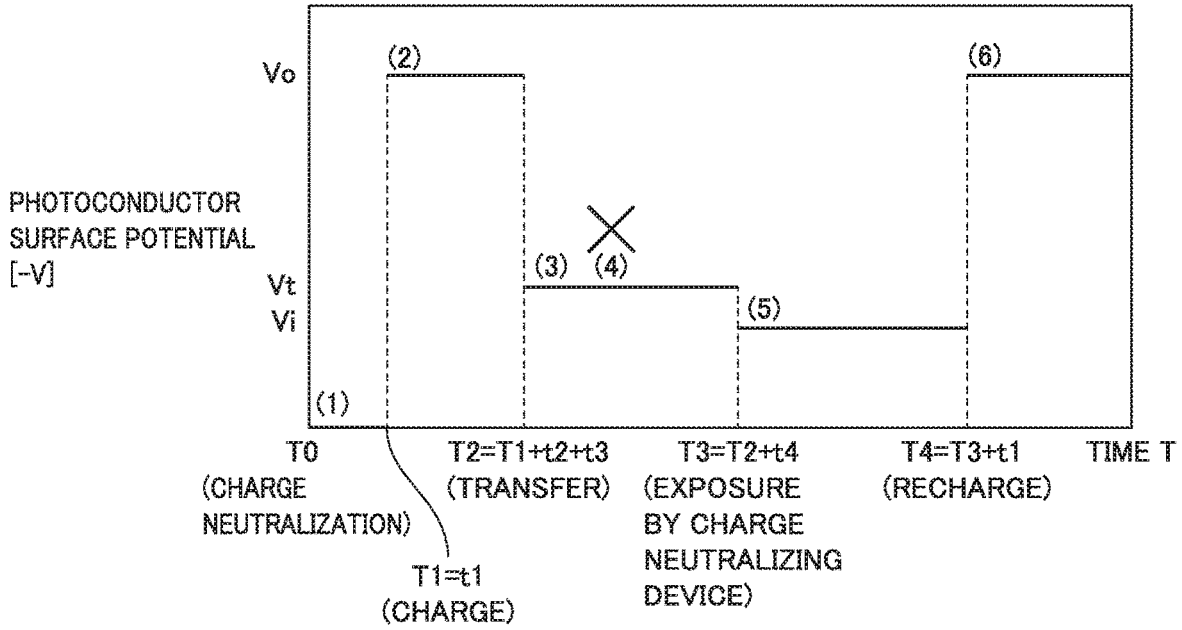
FIG. 15 shows changes in the surface potential of a photoconductor of the modification.

FIG. 14 shows the image forming device in the present modification. FIG. 15 shows changes with time in the surface potential of photoconductor 2 in the present modification. The exposure device is indicated by a mark× in FIG. 14, and this mark× means that the exposure device does not perform exposure.

As step (4) is indicated by the mark× in FIG. 15, the image forming apparatus of the present modification does not need to perform "the process of stopping the application of the transfer voltage and the application of the transfer voltage" of step (4).

A case in which photoconductor 2 is configured to make one rotation in a time period of three seconds will now be described. For example, photoconductor 2 has a diameter of φ30 and a process speed of 290 mm/s. The image forming apparatus of the present modification changes the transfer bias in stages from 500 V to 2500 V in increments of 500 V. The transfer bias is started to be changed from 500 V and is increased by 500 V per 0.6 seconds. This can increase the transfer bias from 500 V to 2500 V at a constant rate (every time 0.6 second elapses) during one rotation of photoconductor 2 (three seconds).

In the image forming apparatus of the present modification, charge neutralizing device 80 also performs the exposure process as shown in FIG. 14. The image forming apparatus can thus perform a series of processes from transfer by the transfer device to exposure by the charge neutralizing device to charging by the charging device, in agreement with the rotation of photoconductor 2. Transfer current acquirer 182 can accordingly acquire transfer current Itr continuously in synchronization with changes in transfer bias. Along with this, charge current acquirer 184 can acquire charge current Ic continuously in synchronization with changes in transfer bias. This is based on the fact that any appropriate location of photoconductor 2 does not pass through the charge neutralizing device or the charging device after the application of the transfer bias.

When the transfer bias is changed in stages from 500 V in increments of 500 V per 0.6 seconds, charge current acquirer 184 can acquire the charge current at five points identical to the number of changes in transfer bias.

When the image forming apparatus uses the charge neutralizing device as the exposure device as in the present modification, characteristic acquirer 186 can acquire Itr-Ic characteristics during one rotation of photoconductor 2 by changing the transfer bias continuously or in stages. Consequently, change characteristic acquirer 188 can acquire the first point of change and the second point of change during one rotation of photoconductor 2. The image forming apparatus of the present modification can reduce the rotation number of photoconductor 2. This reduces damage to photoconductor 2 due to the calculation of post exposure potential Vi and reduces a downtime of the user.

(3) Description has been given with reference to FIG. 12 assuming that there are two amounts of operation P and two post exposure potentials Vi. Alternatively, there may be three or more amounts of operation P and three or more post exposure potentials Vi. The image forming apparatus can calculate a more accurate maximum operation amount Pmax with more amounts of operation P and more post exposure potentials Vi.

(4) The present embodiment has also illustrated the operation amount of photoconductor 2 as a use amount of the image forming apparatus used for calculating maximum operation amount Pmax. Alternatively, the use amount of the image forming apparatus may include any other parameter. The other parameter may include a durability history of the image forming apparatus. The durability history of the image forming apparatus includes, for example, at least one of a voltage applied to the charging device (charge roller) and a voltage applied to the transfer device (transfer roller). The image forming apparatus may calculate maximum operation amount Pmax by machine learning such as multiple regression analysis using a plurality of parameters as the other parameter.

(5) Next, the prediction of the life of photoconductor 2 using the management device (not shown) will be described. The management device is also referred to as CSRC (CS Remote Care). The management device is communicably connected to a plurality of image forming apparatuses.

When having calculated post exposure potential Vi in the life detection mode, the image forming apparatus transmits durability data at the time of the calculation of post exposure potential Vi and the calculated post exposure potential Vi to the management device. The durability data includes, for example, at least one of voltage (charge voltage, transfer voltage), an operation amount (such as rotation number) of photoconductor 2, the temperature in the image forming apparatus, and the humidity in the image forming apparatus.

Since the management device is communicably connected to each of the plurality of image forming apparatuses, each of the plurality of image forming apparatuses can transmit post exposure potential Vi and the durability data to the management device.

Upon receipt of the durability data and post exposure potential Vi from the plurality of image forming apparatuses, the management device associates (links) post exposure potential Vi and the durability data to each other and store them as correspondence data. The management device can perform machine learning based on pieces of correspondence data from the plurality of image forming apparatuses to predict the life of photoconductor 2 from the durability data of the image forming apparatus and post exposure potential Vi corresponding to the durability data. The prediction of the life includes a process of determining whether the end of the life of photoconductor 2 has been reached and a process of determining, when the end of the life of photoconductor 2 has not been reached, how much photoconductor 2 will operate before the arrival of the end of the life of photoconductor 2.

The management device performs such machine leaning and transmits the result of the prediction of the life of photoconductor 2 to the image forming apparatus (image forming apparatus that has transmitted post exposure potential Vi and durability data). Such a configuration allows the image forming apparatus to predict the life of photoconductor 2 without calculating the graph as shown in FIG. 12. The image forming apparatus can thus reduce a burden of performing the processes.

(6) Description has been given assuming that the image forming apparatus of the present embodiment performs a first process of predicting the life of photoconductor 2 based on post exposure potential Vi. The image forming apparatus of the present modification performs a second process of predicting the life of photoconductor 2 from changes in current associated with changes in the film thickness of photoconductor 2 as well as the first process. The current in this second process includes at least one current of the charge current and the transfer current.

Figure 16:
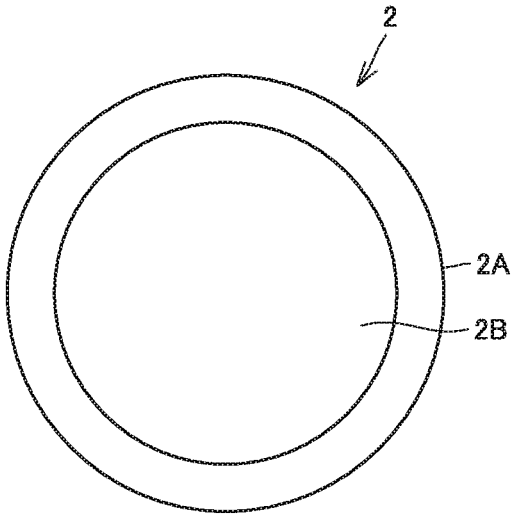
FIG. 16 shows a cross-section of the photoconductor.

FIG. 16 shows a cross-section of photoconductor 2. As shown in FIG. 16, photoconductor 2 includes a cylindrical main body 2B and a photoconductor film 2A provided on the circumference of main body 2B. The image forming apparatus predicts the life of photoconductor 2 from changes in current associated with changes in the film thickness of photoconductor film 2A. Various processes are performed as the second process.

The controller (e.g., determiner) of the image forming apparatus of the present modification calculates the first allowable operation amount by performing the first process. The controller (e.g., determiner) of the image forming apparatus performs the second process to calculate the operation amount (referred to as the second allowable operation amount) of photoconductor 2 until the end of the life of photoconductor 2 is reached. The controller compares the first allowable operation amount with the second allowable operation amount, and determines a smaller amount of the first allowable operation amount and the second allowable operation amount as the allowable operation amount of photoconductor 2.

The image forming apparatus adopting such a configuration predicts the life of photoconductor 2 (predicts the allowable operation amount of photoconductor 2) in consideration of the first allowable operation amount calculated in the first process, as well as the second allowable operation amount calculated in the second process. The life of photoconductor 2 can thus be predicted accurately.

Although embodiments of the present invention have been described and illustrated in detail, the disclosed embodiments are made for purposes of illustration and example only and not limitation. The scope of the present invention should be interpreted by terms of the appended claims

What is claimed is:

1. An image forming apparatus comprising:

a transfer member;

an image carrier;

a charging device configured to charge the image carrier based on a charge voltage;

a charge current acquirer configured to detect a charge current output when the image carrier is charged;

an exposure device configured to expose the image carrier;

a transfer device configured to transfer a toner image to the transfer member upon application of a transfer voltage;

a transfer current detector configured to detect a transfer current output upon application of the transfer voltage;

a characteristic acquirer configured to change the transfer voltage to a plurality of voltage values and acquire characteristics of the transfer current and the charge current based on the transfer current and the charge current at each of the plurality of voltage values;

a change characteristic acquirer configured to acquire a first change characteristic and a second change characteristic for each of a first charge voltage and a second charge voltage, the first change characteristic being a characteristic in a condition where a change amount of a ratio of the charge voltage to the transfer current is a first value, and the second change characteristic being a characteristic in a condition where the change amount of the ratio of the charge voltage to the transfer current is a second value smaller than the first value;

a calculator configured to calculate a post exposure potential after the exposure by the exposure device based on the first charge voltage, the second charge voltage, the charge current in the first change characteristic when the charge voltage is the first charge voltage, the charge current in the second change characteristic when the charge voltage is the first charge voltage, the charge current in the first change characteristic when the charge voltage is the second charge voltage, and the charge current in the second change characteristic when the charge voltage is the second charge voltage; and a determiner configured to make a determination of the life of the image carrier based on the post exposure potential.

2. The image forming apparatus according to claim 1, wherein the determiner is configured to determine whether the post exposure potential is more than or equal to a threshold voltage, when it is determined that the post exposure potential is more than or equal to the threshold voltage, the determiner is configured to perform a change process of changing an exposure intensity of the exposure device, and the calculator is configured to perform a process of calculating the post exposure potential again at the changed exposure intensity, and the change process and the process of calculating the post exposure potential again by the calculator are repeated until the post exposure potential calculated again falls below the threshold voltage.

3. The image forming apparatus according to claim 2, wherein the determiner is configured to determine that the life of the image carrier is reached when the exposure intensity reaches a maximum exposure intensity through the change process and when the determiner determines that the post exposure potential calculated again is more than the threshold voltage.

4. The image forming apparatus according to claim 2, further comprising an image forming device configured to form an image on a sheet, wherein the exposure device is configured to, when the determiner determines that the post exposure potential calculated again is less than the threshold voltage, expose the image carrier at an exposure intensity in the determination such that the image forming device forms an image on a sheet.

5. The image forming apparatus according to claim 1, wherein the determiner is configured to acquire a first allowable operation amount of the image carrier based on the post exposure potential calculated by the calculator, a use amount of the image forming apparatus when the post exposure potential is calculated, a previous post exposure potential calculated before the post exposure potential, and a use amount of the image forming apparatus when the previous post exposure potential is calculated.

6. The image forming apparatus according to claim 5, wherein the determiner is configured to acquire a second allowable operation amount of the image carrier from a film thickness of the image carrier, and determine a smaller amount of the first allowable operation amount and the second allowable operation amount as an allowable operation amount of the image carrier.

7. The image forming apparatus according to claim 1, further comprising a charge neutralizing device configured to neutralize a charge of the image carrier before the image carrier is charged by the charging device.

8. The image forming apparatus according to claim 7, wherein the charge neutralizing device is configured to perform a process identical to a process performed by the exposure device.

9. The image forming apparatus according to claim 1, wherein the exposure device is configured to neutralize a charge of the image carrier before the image carrier is charged by the charging device.

10. A method of controlling an image forming apparatus, the method comprising:

exposing an image carrier;

detecting a charge current output when the image carrier is charged;

detecting a transfer current output upon application of a transfer voltage;

changing the transfer voltage to a plurality of voltage values and acquiring characteristics of the transfer current and the charge current based on the transfer current and the charge current at each of the plurality of voltage values;

acquiring a first change characteristic and a second change characteristic for each of a first charge voltage and a second charge voltage, the first change characteristic being a characteristic in a condition where a change amount of a ratio of the charge voltage to the transfer current is a first value, and the second change characteristic being a characteristic in a condition where the change amount of the ratio of the charge voltage to the transfer current is a second value smaller than the first value;

calculating a post exposure potential after the exposure based on the first charge voltage, the second charge voltage, the charge current in the first change characteristic when the charge voltage is the first charge voltage, the charge current in the second change characteristic when the charge voltage is the first charge voltage, the charge current in the first change characteristic when the charge voltage is the second charge voltage, and the charge current in the second change characteristic when the charge voltage is the second charge voltage; and making a determination of the life of the image carrier based on the post exposure potential.

11. The method according to claim 10, wherein the making of a determination as to the life of the image carrier based on the post exposure potential includes determining whether the post exposure potential is more than or equal to a threshold voltage, when it is determined that the post exposure potential is more than or equal to the threshold voltage, performing a change process of changing an exposure intensity of an exposure device and performing a process of calculating the post exposure potential again at the changed exposure intensity, and repeating the change process and the process of calculating the post exposure potential again until the post exposure potential calculated again falls below the threshold voltage.

12. The method according to claim 11, wherein the making of a determination as to the life of the image carrier based on the post exposure potential includes determining that an end of the life of the image carrier is reached when it is determined that the exposure intensity reaches a maximum exposure intensity through the change process and when it is determined that the post exposure potential calculated again is more than the threshold voltage.

13. The method according to claim 11, wherein the exposing includes, when it is determined that the post exposure potential calculated again is less than the threshold voltage, exposing the image carrier at an exposure intensity in the determination.

14. The method according to claim 10, wherein the making of a determination as to the life of the image carrier based on the post exposure potential includes acquiring a first allowable operation amount of the image carrier based on the post exposure potential, a use amount of the image forming apparatus when the post exposure potential is calculated, a previous post exposure potential calculated before the post exposure potential, and a use amount of the image forming apparatus when the previous post exposure potential is calculated.

15. The method according to claim 14, wherein the making of a determination as to the life of the image carrier based on the post exposure potential includes acquiring a second allowable operation amount of the image carrier from a film thickness of the image carrier, and determining a smaller amount of the first allowable operation amount and the second allowable operation amount as an allowable operation amount of the image carrier.

16. The method according to claim 10, further comprising neutralizing a charge of the image carrier before the image carrier is charged.

* * * * *